US010533387B2

(12) United States Patent
Dirksen et al.

(10) Patent No.: US 10,533,387 B2
(45) Date of Patent: Jan. 14, 2020

(54) APPARATUS AND METHOD FOR WELL OPERATIONS

(71) Applicant: Halliburton Energy Services, Inc., Houston, TX (US)

(72) Inventors: Ronald Johannes Dirksen, Spring, TX (US); Daniel David Gleitman, Houston, TX (US); William W. Shumway, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/593,023

(22) Filed: May 11, 2017

(65) Prior Publication Data

US 2017/0247959 A1 Aug. 31, 2017

Related U.S. Application Data

(63) Continuation of application No. 13/635,481, filed as application No. PCT/US2011/029520 on Mar. 23, 2011, now abandoned.

(Continued)

(51) Int. Cl.
*E21B 21/08* (2006.01)
*E21B 21/12* (2006.01)

(Continued)

(52) U.S. Cl.
CPC ..... *E21B 21/08* (2013.01); *E21B 21/103* (2013.01); *E21B 21/12* (2013.01); *E21B 34/066* (2013.01);

(Continued)

(58) Field of Classification Search
CPC ..... E21B 34/066; E21B 47/12; E21B 47/124; E21B 47/16
See application file for complete search history.

(56) References Cited

U.S. PATENT DOCUMENTS 2,876,434 A 3/1959 Oberlin
3,175,628 A 3/1965 Dellinger (Continued)

FOREIGN PATENT DOCUMENTS

EP 0911483 4/1999
WO WO 9749889 12/1997
WO WO 02/29200 4/2002

OTHER PUBLICATIONS

Ese, Marit-Helen, and Peter Kilpatrick. "Stabilization of Water-in-Oil Emulsions by Napthenic Acids and Their Salts: Model Compounds, Role of PH, and Soap: Acid Ratio." Journal of Dispersion Science and Technology 25.3 (2004): 253-61. Print.

(Continued)

*Primary Examiner* — Kristyn A Hall
*Assistant Examiner* — Tara E Schimpf
(74) *Attorney, Agent, or Firm* — McGuireWoods LLP

(57) ABSTRACT

A method for modifying a return fluid in a wellbore comprising disposing at least one valve along a drill pipe section of a drill string in the wellbore. At least one parameter of interest is determined at at least one location along the wellbore. At least one valve is controllably actuated to discharge at least a portion of at least one fluid from inside the drill string to an annulus in the wellbore to modify a local property of the return fluid in the annulus based at least in part on the measured parameter of interest.

20 Claims, 15 Drawing Sheets

Related U.S. Application Data

(60) Provisional application No. 61/316,819, filed on Mar. 23, 2010.

(51) Int. Cl.

| | |
|---|---|
| ***E21B 34/06*** | (2006.01) |
| ***E21B 21/10*** | (2006.01) |
| ***E21B 47/06*** | (2012.01) |
| *E21B 21/00* | (2006.01) |
| *E21B 47/12* | (2012.01) |

(52) U.S. Cl.

CPC ..... *E21B 47/06* (2013.01); *E21B 21/003* (2013.01); *E21B 47/12* (2013.01)

(56) References Cited

U.S. PATENT DOCUMENTS

| | | | | |
|---|---|---|---|---|
| 3,534,822 | A | 10/1970 | Campbell | |
| 4,645,006 | A | 2/1987 | Tinsley | |
| 5,160,928 | A | 11/1992 | Dailey | |
| 5,343,968 | A | 9/1994 | Glowka | |
| 5,407,020 | A | 4/1995 | Beavers | |
| 6,220,087 | B1 | 4/2001 | Hache | |
| 6,279,392 | B1 | 8/2001 | Shahin | |
| 6,296,056 | B1 | 10/2001 | Ward | |
| 6,497,290 | B1 | 12/2002 | Misselbrook | |
| 6,530,437 | B2 | 3/2003 | Maurer | |
| 6,906,009 | B2 | 6/2005 | Shinbach | |
| 7,090,036 | B2 | 8/2006 | deBoer | |
| 7,108,066 | B2 | 9/2006 | Jamison | |
| 7,482,309 | B2 | 1/2009 | Ravi | |
| 2003/0192695 | A1 | 10/2003 | Dillenbeck | |
| 2004/0084214 | A1* | 5/2004 | deBoer | E21B 21/001 175/7 |
| 2004/0108138 | A1 | 6/2004 | Cooper | |
| 2005/0194184 | A1 | 9/2005 | Gleitman | |
| 2007/0027036 | A1 | 2/2007 | Polizzotti | |
| 2008/0029306 | A1* | 2/2008 | Krueger | E21B 21/103 175/210 |
| 2008/0060846 | A1* | 3/2008 | Belcher | E21B 17/042 175/25 |
| 2009/0133868 | A1 | 5/2009 | Sullivan | |
| 2009/0166031 | A1* | 7/2009 | Hernandez | E21B 21/08 166/250.01 |
| 2009/0166087 | A1 | 7/2009 | Braden | |
| 2009/0272580 | A1 | 11/2009 | Dolman | |
| 2010/0067329 | A1 | 3/2010 | Edwards | |

OTHER PUBLICATIONS

International Search Report dated May 19, 2011 on related PCT/US2011/029520.

Extended European Search Report dated Sep. 5, 2017 on related EP Application No. EP11760105.4.

* cited by examiner

APPARATUS AND METHOD FOR WELL OPERATIONS

BACKGROUND

The present disclosure relates generally to the field of well drilling.

Generally, when drilling a well, the pore pressure gradient and the fracture pressure gradient increase with the true vertical depth (TVD) of the well. Typically for each drilling interval, a mud density (mud weight or MW) is used that is greater than the pore pressure gradient, but less than the fracture pressure gradient.

As the well is deepened, the mud weight is increased to maintain a safe margin above the pore pressure gradient. If the mud weight falls below the pore pressure gradient, a number of well control issues may arise, for example taking a kick. If the mud weight exceeds the fracture gradient, the formation may be fractured resulting in lost circulation and its associated problems.

To prevent the above situation from occurring, conventional practice typically involves running and cementing a steel casing string in the well. The casing and cement serve to block the pathway for the mud pressure to be applied to the earth above the depth of the casing shoe. This allows the mud weight to be increased so that the next drilling interval can be drilled. This process is generally repeated using decreasing bit and casing sizes until the well reaches the planned depth. Because well costs are primarily driven by the required rig time to construct the well, these processes may increase the cost of drilling the well. Furthermore, with the conventional steel casing tapered-hole-drilling process, the final hole size that is achieved may not be useable, or optimal, and the casing and cement operations substantially increase well costs.

Because of the time and costs associated with running casing strings, it is desirable to drill as long of an open hole as possible. A multi gradient drilling system enhances this capability.

BRIEF DESCRIPTION OF THE DRAWINGS

A better understanding of the present invention can be obtained when the following detailed description of example embodiments are considered in conjunction with the following drawings, in which like elements have like numbers, where.

DETAILED DESCRIPTION

Figure 1:
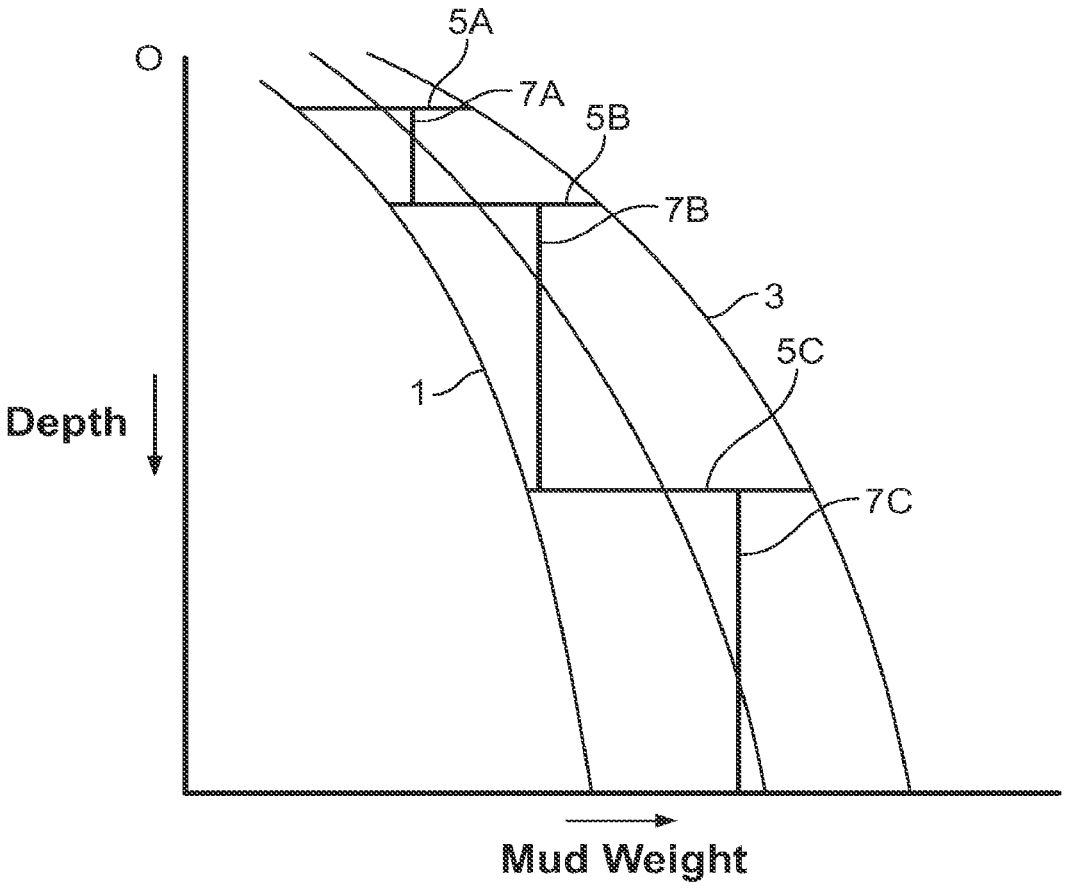
FIG. 1 shows an example of a portion of a pore pressure gradient curve and a fracture gradient curve with example casing setting points.

FIG. 1 shows an example of a portion of a pore pressure gradient curve 1 and a fracture gradient curve 3 with example casing setting points 5. The mud densities 7A-C (also called mud weight in the industry) may be set for the given casing setting points SA-C to result in an annulus fluid pressure above the pore pressure gradient curve 1 but below the fracture gradient curve 3. The casing setting points 5 permit increased open-hole minimum fracture gradients so that a higher mud density can be used in each successive open hole section of the wellbore.

Figure 2:
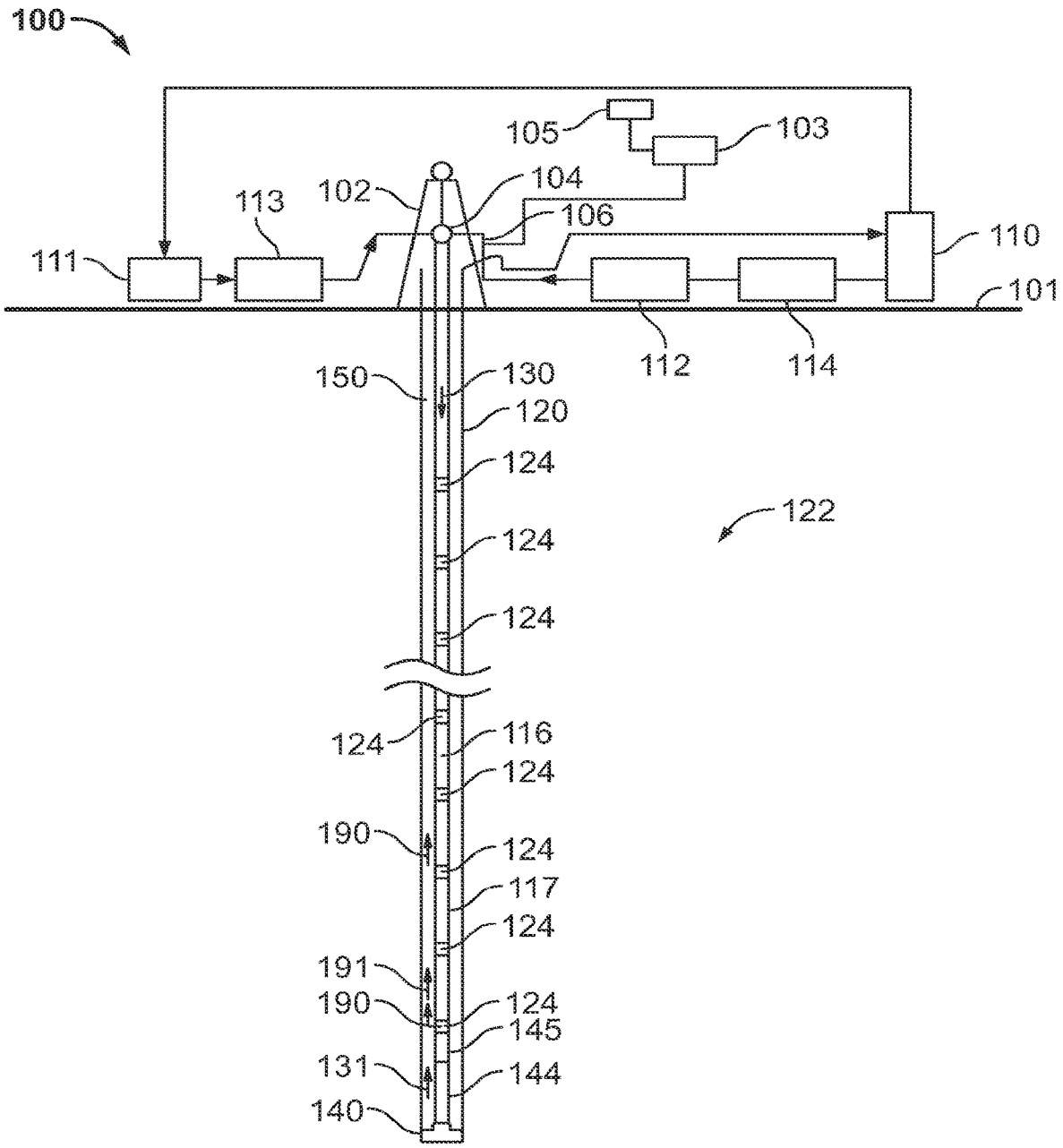
FIG. 2 shows an example of a drilling system.

FIG. 2 shows a drilling system 100 that may be used to modify return fluid properties along the wellbore 120. Drilling rig 102 is used to extend a drill string 122 into wellbore 120. Drill string 122 may comprise a drill pipe section 116 and a bottom hole assembly (BHA) 117. Drill string 122 may comprise standard drill pipe, drill collars, wired drill pipe, wired drill collars, coiled tubing, and combinations thereof. Drill pipe section 116 may comprise drill pipe joints 118 that may comprise wired pipe to provide bi-directional communication of data and/or power between the surface and downhole devices described herein. Wired pipe is commercially available, for example the Intelliserv® brand of wired pipe marketed by National Oilwell Varco. Any other suitable wired pipe may also be used.

BHA 117 couples to the bottom of drill pipe section 116 and may comprise a measurement-while-drilling (MWD) tool 145 comprising one or more MWD sensors, a drilling motor 144, a rotary steerable device, a drill bit 140, drill collars, stabilizers, reamers, and other common BHA elements. BHA 117 may be of relatively short length, for example 30 to 300 feet, as compared to the overall drill string 122 which may be several thousand feet of length. Certain of the above mentioned BHA devices and/or sensors may be in wired or wireless communication between each other as is known in the industry, and may additionally interface with a communications link to or through the drill pipe section 116, for high data rate communication to and from surface. Some implementations may include a communication network along part, or all, of drill pipe section 116, with nodes (for data acquisition, receipt, and/or handling) at one or more locations along drill pipe section 116 above the BHA (117), this network may utilize one or more communication media or techniques including but not limited to: wired pipe, mud pulse telemetry, low frequency (under 1000 Hz) electromagnetic telemetry ("EM telemetry"), RF telemetry, acoustic telemetry, hard wired telemetry, fiber optic telemetry, and combinations thereof. As used herein, "hard wired" refers to one or more conductors providing a continuous electrical path over some length. Examples of hard wired implementations include wired pipe, wireline conveyed down a flow path of drill string, a wireline conveyed down the outside of a drill string, or combinations thereof. Hard wired implementations may include metal to metal connectors, inductive connections, and other connections discussed herein between pipe joints, and/or at other locations along the length of the drill string.

In one embodiment, drill string 122 comprises a multi-channel, axially extending conduit (See FIGS. 5 and 6) wherein a base drilling fluid 130 flows in a first flow channel 404 in a first flow conduit 401, and an additive fluid 190 flows in a second flow channel 403 in a second flow conduit 402. In one example, first flow conduit 401 comprises the drill string 122 member, and second flow conduit 402 is a member nested inside first flow conduit 401. In one example, base drilling fluid 130 is pumped down drill string 122 and exits the drill string to the borehole through openings in bit 140 which is attached to the bottom of drill string 122. As used herein, the term fluid comprises liquids, gases, liquid-solid mixtures, emulsions, and combinations thereof.

In some embodiments, drill string 122 may be configured for wellbore activities other than drilling, and may be used without bit 140, in which case base fluid 130 may exit the drill string to the borehole through the bottom of drill string 122, or through another opening in drill string 122. In some embodiments base fluid 130 may comprise a fluid for other than drilling activities, for example a cement slurry, a displacement fluid, a completion fluid, a stimulation fluid, a gravel pack fluid, any other suitable wellbore fluid, and combinations thereof.

Drill string 122 may be run all, or partly, into a borehole, either existing or under construction, for example borehole 120, creating an annulus 150 between drill string 122 and the wall of borehole 120. Annulus 150 may be a return path for fluid pumped from surface into drill string 122. Borehole 120 may be all or partially cased along its length.

Those skilled in the art will appreciate that, in some embodiments, one or more flow return devices (not shown) may be used at, or near, surface 101 for controlling flow returns from the annulus, for example conventional blow out preventers, rotating control devices, and fixed or adjustable chokes. A pump or other fluid source may at times be hydraulically coupled to the annulus for purposes of circulating fluid down the annulus, or charging the annulus with pressure.

In some embodiments, sensors may be provided at or near surface 101, for making measurements of one or more of input and output fluids, and may comprise pressure sensors, flow rate sensors, fluid composition sensors, fluid phase sensors, and other suitable sensors, located at the standpipe, at a base fluid pump, at an additive fluid pump, upstream or downstream of a surface choke, and/or on a riser or other conduits which convey a base fluid and/or an additive fluid.

In one example, as shown in FIG. 2, a plurality of valve subs 124 are disposed at axially spaced apart locations in drill string 122. One or more valve subs 124 may be located within the BHA 117. One or more valve subs 124 may be located separate from and above the BHA 117 in drill pipe section 116. Such drill pipe section 116 valve subs 124 may be located in between sections of conventional drill pipe, or in between sections of wired drill pipe. Valve subs 124 may be internally ported to pass base drilling fluid 130 through valve subs 124 onward through drill string 122 to bit 140. In one example, valve subs 124 may also comprise an internal valve mechanism that controllably dispenses additive fluid 190 from second flow channel 403 (FIG. 5) into annulus 150 to mix with a return fluid 131 that comprises returning base drilling fluid 130, entrained cuttings, and any fluid influx from the surrounding formation. The addition of additive fluid 190 may result in a modified return fluid 191 that has a locally controllable property. In one example, the locally controlled property may be a physical property, for example density and/or viscosity of the return fluid. For example, by modifying the density of the modified return fluid 191, at different locations along the annulus return path, a multi-gradient pressure profile may be generated along the annulus return path that provides enhanced drilling control and a wellbore that may require fewer casing strings. The term "multi-gradient" will be understood to mean two or more gradients. Other examples of a locally modified and/or controlled property comprise a flow property, a composition property, a chemical composition, and a chemical property, all discussed below.

In one example, the modified return fluid 191 is returned to the surface and the constituents may be separated in separator 110, with base fluid 130 going to tank 114 and additive fluid 190 going to vessel 111. Pump 112 pumps base fluid 130 downhole through one channel of drill string 122. Likewise, fluid mover 113 forces additive fluid 190 downhole through second channel in drill string 122. Additive fluid 190 may comprise a liquid, a gas, a liquid-solid mixture, and combinations thereof. Fluid mover 113 may comprise a pump and/or a compressor depending on the form of additive fluid 190.

In one example, base fluid 130 may comprise a water base mud (WBM) with a specific gravity of about 1.0 to about 2.2. Additive fluid 190 may comprise a fluid with a specific gravity less than that of the base fluid. Additive fluid 190 may comprise an oil base liquid, fresh water, a brine, a gas, a foam, a chemical additive, an emulsion, a solid-liquid mixture, and combinations thereof. Examples of a gas include, but are not limited to, air, vitiated air, carbon dioxide, natural gas, flue gas, and nitrogen. In one example additive fluid 190 may comprise the same fluid as base fluid 130. Additive fluid 190 may comprise a gas with additives, which may result in a mist or foam. Additive fluid 190 may comprise a combination of any of the aforementioned.

In some embodiments base fluid 130 may be any of the aforementioned fluids, or combinations thereof, and additive fluid 190 may be another of the aforementioned fluids or combinations thereof. The invention contemplates additive fluid 190 of lesser, equal, or greater specific gravity than base fluid 130. Additive fluid 190 may comprise a fluid with lesser, equal, or greater viscosity and/or yield strength than the base fluid.

In some embodiments base fluid 130 may comprise a particular of the aforementioned fluids or combinations thereof, and additive fluid 190 may comprise the same fluid or combination thereof.

In one example related to FIG. 2, valve subs 124 may controllably dispense additive fluid 190 into annulus 150 to mix with return fluid 131 and result in a modified return fluid 191 that has a locally controllable flow property, the locally controlled flow property comprising one or more of flow rate, flow velocity, flow rate or flow velocity of a particular phase (in cases of multi-phase flow). By adjusting one or more of the aforementioned properties of the modified return fluid 191, at one or more locations along the annulus return path, a stepped gradient, also called multi-gradient, flow rate or velocity profile may be generated along the annulus return path which may result in enhanced hole cleaning or other advantages.

In yet another example related to FIG. 2, valve subs 124 may controllably dispense additive fluid 190 into annulus 150 to mix with return fluid 131 and result in a modified return fluid 191 that has a locally controllable property. The locally controlled property may comprise a change in composition and/or chemistry, as compared to the composition and/or chemistry at another location of the annulus flowpath, and/or as compared to an earlier point in time. The changed composition and/or chemistry of return fluid 191 may react differently with the borehole or drill string. By injecting a chemical additive and adjusting the chemistry, for example, of the modified return fluid 191, at one or more locations along the annulus return path, enhanced conditions may be generated such as inhibition of reactive shales, stabilization of the borehole wall, reduced borehole fluid losses to the formation, reduced (or increased) influx of fluids to the borehole, improved hole cleaning, or reduced frictional drag of the drill string on the borehole wall. Example chemical additives include, but are not limited to: sealants, viscosity modifiers, friction reducers, acid modifiers, and any other suitable additives.

In one example, a compositional change may be affected wherein additive fluid 190 may comprise a sealant material, for example a lost circulation material ("LCM") of composition, size, and/or chemistry intended to isolate the subterranean formation from a portion of the wellbore; to support a casing in the wellbore; to plug a void or crack in the casing; to plug a void or crack in a cement sheath disposed in an annulus of the wellbore; to plug an opening between the cement sheath and the casing; to prevent the loss of aqueous or non-aqueous drilling fluids into lost circulation zones such as a void, vugular zone, or fracture; to be used as a fluid in front of cement slurry in cementing operations; to seal an annulus between the wellbore and an expandable pipe or pipe string; and combinations thereof.

In another embodiment, the sealant material may comprise an inverse emulsion polymer comprising a water-in-oil emulsion with a water swellable polymer dispersed in the emulsion. The emulsion may contain a continuous phase of oil and a dispersed phase of water. The oil may be any oil that is immiscible with water and suitable for use in a wellbore. Without limitation, examples of suitable oils include a petroleum oil, a natural oil, a synthetically derived oil, a mineral oil, silicone oil, or combinations thereof. In some embodiments, the oil may be an alpha olefin, an internal olefin, an ester, a diester of carbonic acid, a paraffin, a kerosene oil, a diesel oil, a mineral oil, silicone oil, or combinations thereof. The water may be any suitable water for forming the dispersed phase and for use in a wellbore. Without limitation, examples of suitable waters include deionized water, municipal treated water; fresh water; sea water; naturally-occurring brine; a chloride-based, bromide-based, or formate-based brine containing monovalent and/or polyvalent cations; or combinations thereof. Examples of suitable chloride-based brines include without limitation sodium chloride and calcium chloride. Further without limitation, examples of suitable bromide-based brines include sodium bromide, calcium bromide, and zinc bromide. In addition, examples of formate-based brines include without limitation sodium formate, potassium formate, and cesium formate.

In some embodiments, the sealant composition may comprise additives that may be suitable for improving or changing its properties. Without limitation, examples of suitable additives include particulate materials, viscosifying agents, weighting materials, and combinations thereof.

In another embodiment, the sealant material may comprise a cement slurry. In one example, a cement material may be pumped down the first flow channel in the drill string, and up the annulus. A flash accelerator may be pumped down a second flow channel and injected into the cement in the annulus at the desired location. Example of a flash accelerator may comprise sodium silicate and sodium metasilicate. In the case of resin products, a resin hardening accelerator, such as an amine accelerator may be used.

In another example, a normally retarded cement mixture may be pumped down a first channel in the drill string and up the annulus. A second, mildly accelerated, cement may be pumped down a second flow channel and injected at a desired point into the normally retarded cement to accelerate the curing in the annulus.

Other examples of sealants may comprise fibrous materials, for example, cellulose fibers. Examples of friction reducers may comprise a slurry containing glass beads. Liquid friction reducers may comprise blends of acids, esters, and natural oils that can effectively reduce torque and drag in water base drilling fluid. One example is the BAROLUBE brand of friction reducer marketed by Halliburton Energy Services, Inc.

Other additives may comprise shale inhibitors, acid inhibitors, oxygen scavengers, and corrosion inhibitors. Examples include, but are not limited to, KCl, Polyhydrolyzed Polyacrylamide (PHPA) organic amines, potassium silicate, and glycol.

In one example, a cross linker, for example a borate material to crosslink Guar, may be injected into a non-cross linked drilling fluid at a specific location along the wellbore annulus to increase viscosity, for example, to increase return fluid viscosity in the horizontal section of a well to increase cutting carrying capacity.

In another example, a cross link breaker, or thinner may be injected into the return fluid in the well bore annulus to decrease viscosity at a selected location along the wellbore. For example, it may be desirable to reduce return fluid viscosity in a vertical section of the well to improve ECD.

In another example, return fluid in an offshore well may experience increased viscosity in the marine riser caused by cooling of the return flow by the surrounding cold sea water, thus increasing the ECD. A viscosity reducer may be injected into the return fluid near the sea floor to reduce the viscosity to improve ECD.

In yet another example, a tar remover, or tar hardener known in the art may be injected into the return fluid at a selected location along the wellbore annulus to deal with tar/bitumen at the point it occurs in the well rather than making it part of the whole fluid system. This may improve the reaction with tar and/or improve overall fluid properties, by not incorporating the additive throughout the total fluid stream.

In one example, it may be advantageous to change the properties of the drilling fluid during the passage of the drilling fluid through in the annulus. In one example, it may be advantageous to drill through a particular formation using a water base mud. However, it may also be advantageous to convert the water base mud to an oil base mud during the transit back up the wellbore annulus in order to protect a previously drilled water sensitive shale. In this example, an oil and water phase inverting emulsion mud may be used. As used herein, the term emulsion means a mixture of two or more immiscible liquids. In one example, an oil base liquid and water may be used as the immiscible liquids. Either the oil base liquid or the water may be the continuous phase with the other liquid being the dispersed phase, depending on the Ph of the mixture. For example, initially, a mud having a continuous water phase and a dispersed oil phase may be pumped down the drill string and partially back up the annulus. Before the emulsion return fluid reaches the water sensitive shale, a Ph trigger, for example a caustic solution, may be injected, using the valve system described herein, into the return fluid at an appropriate location along the annulus to increase the Ph of the return fluid, and change the return fluid from a water continuous phase to an oil continuous phase mixture to protect the water sensitive shale. Alternatively, an acid Ph trigger may be injected into an oil continuous phase mixture to convert the mixture water continuous phase mixture.

In yet another example, one or more additives may be injected into the return fluid stream using one of the controllable valves described previously to mitigate acid gas in the return fluid stream. A non-tertiary amine, for example monoethanolamine may be used. Other examples include, but are not limited to, triazine, ironite sponge, and sulfite based materials.

The invention may include a controller, which may be located in the drill string, sea floor, and in many cases is at surface 101 ("surface controller"). Surface controller 103 may comprise one or more processors, and may be located at least in part at a location remote from the well location, for example at a remote data center. The remote data center may be linked to the wellsite by wire or wireless data links. Surface controller 103 may include a user interface, which may comprise one or more of graphical or numeric output displays 105 that may provide a log display of pressures, flow rates, flow velocities, flow composition, or other parameters versus depth and/or time. Other displays may comprise open/closed/metering status of distributed valves, and may include results of models and/or processing of downhole data. As is common, a keyboard and/or mouse may be used for user inputs. Surface controller 103 may receive signals from downhole using suitable telemetry techniques described below. Surface controller 103 comprises a processor in data communication with a memory for containing instructions and models for controlling the operations described below. Communications between the surface controller and the downhole systems may be by mud pulse telemetry, low frequency (under 1000 Hz) electromagnetic telemetry ("EM telemetry"), RF telemetry, acoustic telemetry, hard wired telemetry, fiber optic telemetry, and combinations thereof.

Figure 3A:
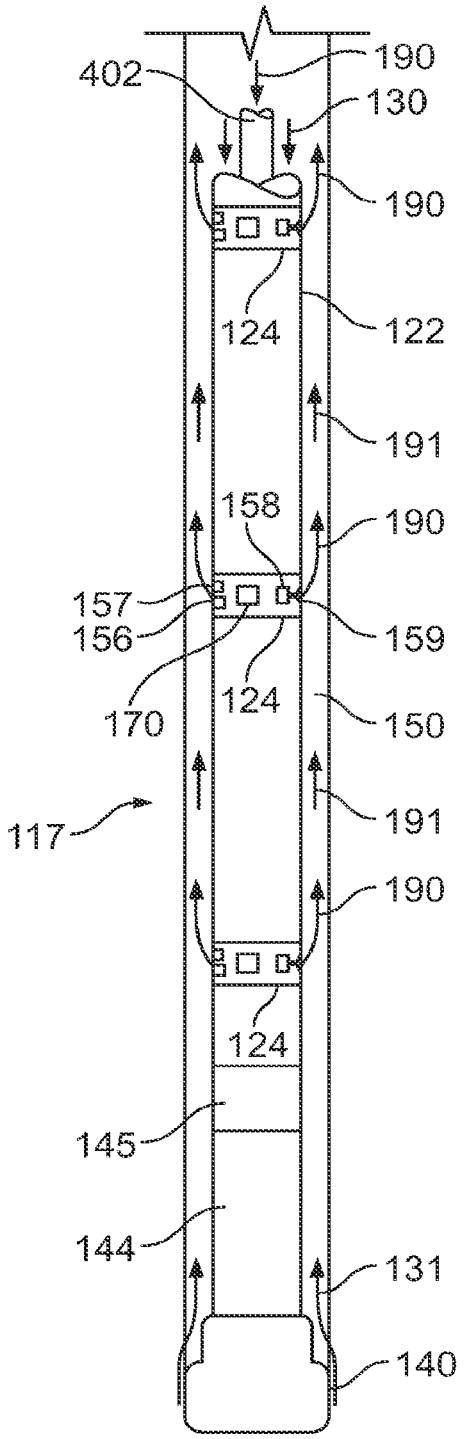
FIGS. 3A and 3G show an enlarged view of portions of a drill string.
Figure 3G:
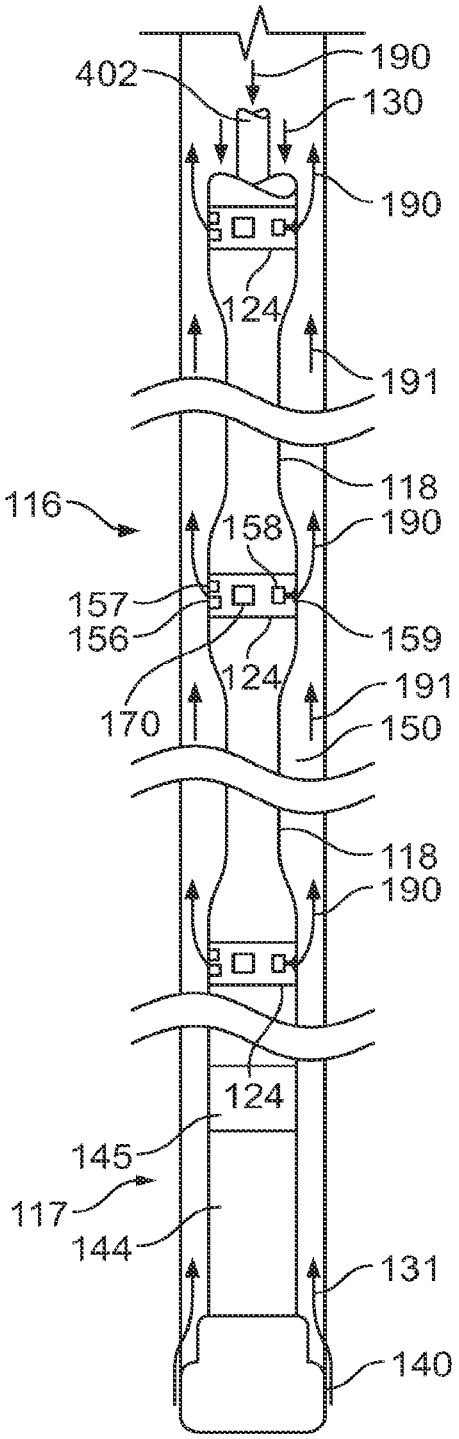

FIGS. 3A and 3G show an enlarged view of portions of drill string 122 comprising BHA 117 (FIG. 3A) and drill pipe section 116 (FIG. 3G) each comprising valve subs 124 located therein. Each valve sub 124 may comprise a controllable valve 158 in fluid communication with at least one flow port 159 that is in fluid communication with return annulus 150. Each valve sub 124 may also comprise at least one sensor 157, at least one communication transmitter/receiver 156, a valve sub controller 170, and a power source 180. In one example, controllable valve 158 may comprise a shear valve. Alternatively, controllable valve 158 may be a poppet valve, a rotary valve, or any other suitable valve configuration. Alternatively, controllable valve 158 may be a burst plate, blowable plug, or other non-resettable flow control device. Controllable valve 158 may be a check type valve operable (to open or close) at particular pressure levels. Controllable valve 158 may be capable of full open/full close operation, may be capable of metering flow, and/or may be adjustable between two or more restrictions. In some embodiments controllable valve 158 may not have a fully-closed setting. FIGS. 3B and 3D show examples of a valve sub 124 located in BHA 117 and drill pipe section 116 respectively.

In one example sensors 157 may be commercially available pressure sensors that convert pressures to one or more signals. Such pressure sensors may include strain gauge type devices, quartz crystal devices, fiber optical devices, or other devices used to sense pressure. The one or more signals from the pressure sensors may be analog or digital. In certain implementations, one or more pressure sensors may be oriented to measure one or more static pressures. For example, one or more pressure sensors may be oriented perpendicular to streamlines of the drilling fluid flow. One or more pressure sensors may measure stagnation pressure by orienting the pressure sensors to face, or partially face, into the drilling fluid flow. In certain implementations, one or more pressure sensors may use an extended pitot tube approach or a shallow ramping port to orient the sensors to face, or partially face, into the drilling fluid flow. The measurement accuracy of the stagnation pressure may vary depending on a degree of boundary layer influence.

In one example, valve sub 124 may be a unitary sub, or a combination of subs which are coupled to drill string 122 and together comprise the aforementioned elements. Valve subs 124 may be located within the BHA 117, and/or along drill pipe section 116. In some examples, one or more of the aforementioned transmitter/receiver 156, controller 170, and power source 180 associated with a valve sub may be physically remote (for example up or down the drill string) from the valve sub 124, though still operably coupled (for example by wires) to the other elements of the valve sub as required for the operation described herein.

Flow port 159 may be configured to direct fluid in a radial direction towards the borehole wall. In some embodiments, see FIGS. 3E and 3F, flow port 159 may comprise a directional nozzle 198 that directs flow in a direction with a vector component at least partially parallel to the drill string, in an uphole or downhole direction, or in a direction with a vector component tangent to the circumference of the drill string. Flow port 159 may be configured to focus the exiting fluid in a narrow jet, or more broadly dispersed flow, or other flow cross section or profile. In some embodiments two or more flow ports 159 may be in fluid communication with a single controllable valve 158. The two or more flow ports 159 may be arranged around the circumference of the drill string at a particular location along the length of the drill string, at a single circumferential orientation along the length of the drill string, with a defined offset in relative position along the length or orientation, or a combination of any of the foregoing. Flow port(s) 159 may be configured to direct fluid in a manner to control fluid impingement on the borehole wall, control flow jetting along the length of the borehole, and along the circumference of the drill string in a particular orientation of the drill string (which may be related to the orientation of the borehole), or to control flow mixing. Flow port(s) 159 may be configured for the fluid exiting the fluid port(s) 159 to help agitate and mix materials, for example, cuttings entrained in the annulus mud, mobilize cuttings along the bottom of a slant, curve, or horizontal section, provide a concentrated or evenly distributed material towards the borehole wall or into the annulus, remove material such as filter cake from the borehole wall, or to avoid one or more of the foregoing.

In one example, the at least one sensor 157 may comprise at least one sensor chosen from the group consisting of: a pressure sensor, a temperature sensor, a flow sensor, a resistivity sensor, a pH sensor, an acoustic sensor, a chemical sensor, an optical sensor, and a nuclear sensor. Parameters of interest measured by these types of sensors comprise fluid pressure, fluid temperature, fluid density, fluid flow rate, fluid flow velocity, flow rate of a particular phase, flow velocity of a particular phase, fluid resistivity, fluid pH, fluid viscosity, and fluid chemical composition. Valve sub controller 170 may also comprise a 2 axis or a 3 axis accelerometer sensor, a gyro, or inclinometer of any type, to determine the local inclination of valve sub 724 with respect to a vertically downward direction with respect to gravity. Valve sub controller 170 may also comprise an orientation sensor, which may utilize the aforementioned multi-axis accelerometers or gyro, or multi-axis magnetometers, to determine the local rotational orientation of valve sub 724 or flow port(s) 759 with respect to the high side of the hole, and/or a compass heading. Transmitter/receiver 156 may comprise a single device performing both functions, or, alternatively may comprise a separate device for each function. Transmitter/receiver 156 may enable communication between the various valve subs 724. Transmitter/receiver 156 may also enable communication between a valve sub 724 and surface controller 103. Communications between a valve sub and another valve sub may be by mud pulse telemetry, EM telemetry, RF telemetry, acoustic telemetry, optical telemetry, hard wired telemetry, and combinations thereof. Communications between a valve sub and surface controller 103 may be by mud pulse telemetry, EM telemetry, RF telemetry, acoustic telemetry, optical telemetry, hard wired telemetry, and combinations thereof.

Figure 3C:
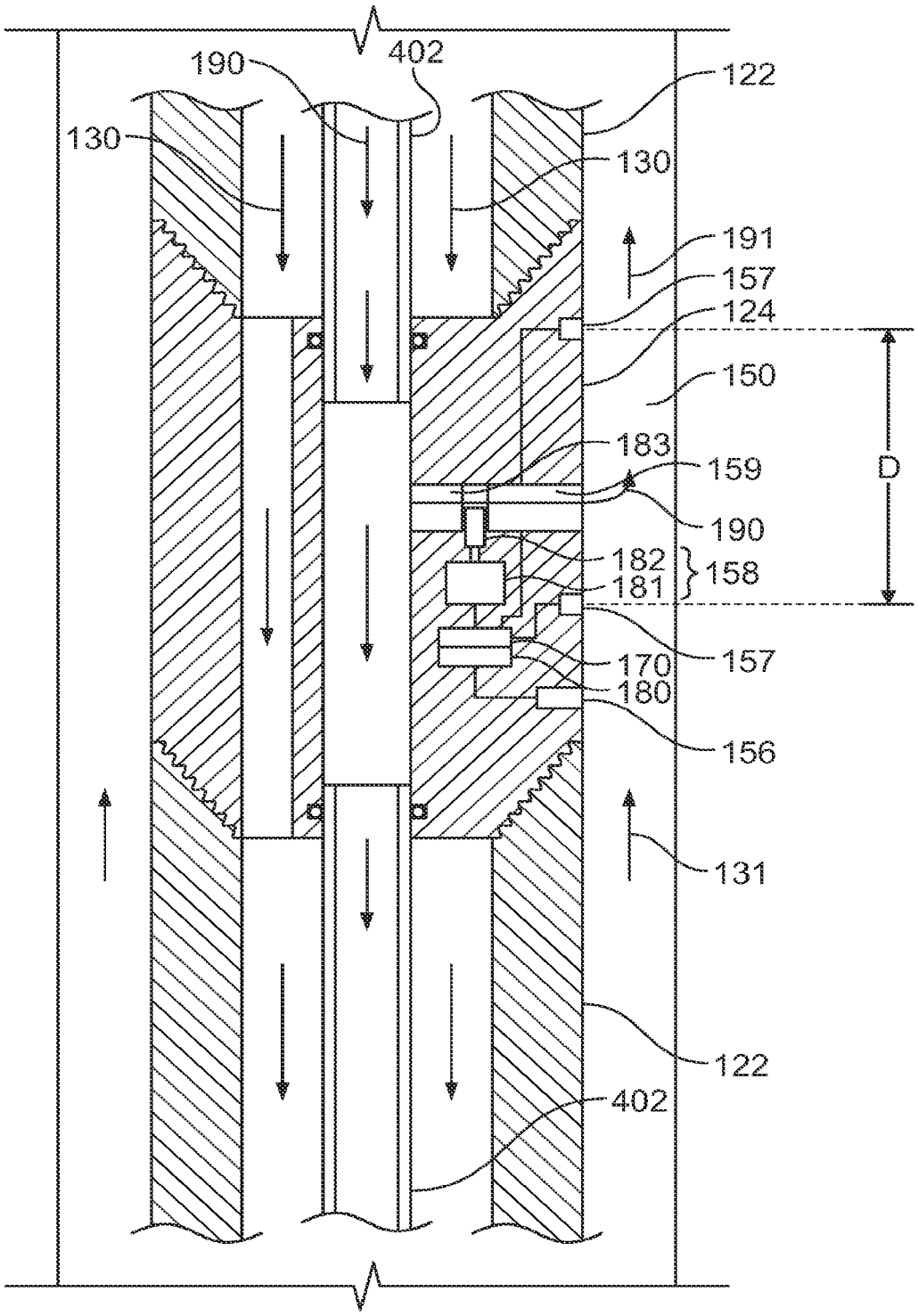
FIG. 3C shows one example of a valve sub comprising a shear valve.
Figure 3B:
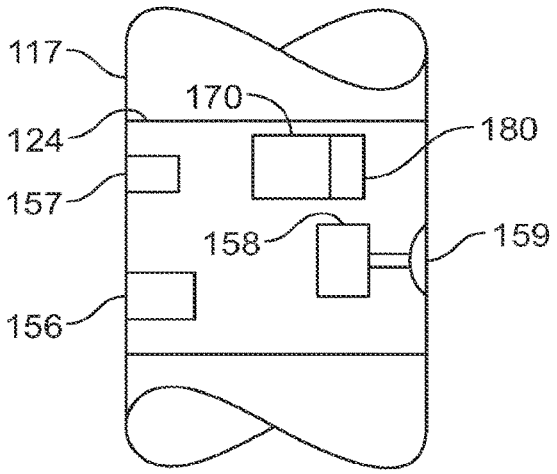
FIG. 3B shows an example of a valve sub located in BHA.
Figure 3D:
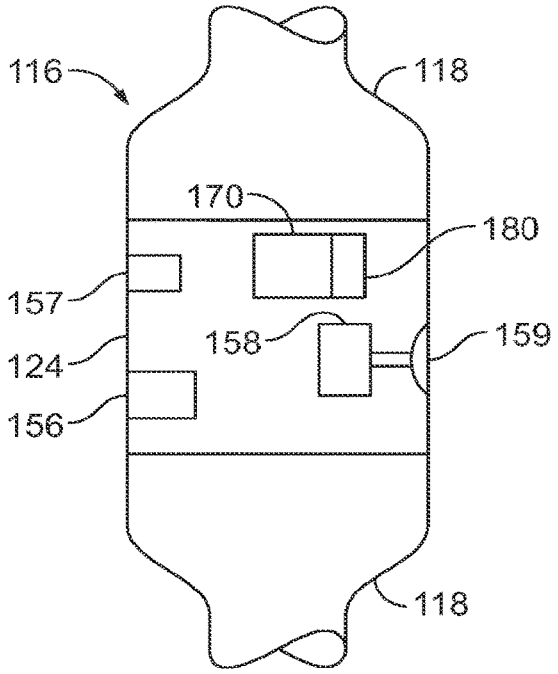
FIG. 3D shows an example of a valve sub in a drill pipe section.
Figure 3E:
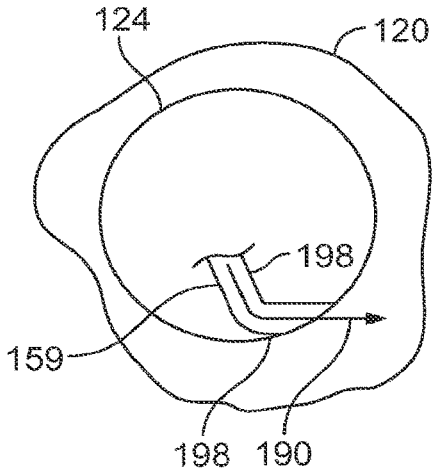
FIGS. 3E and 3F show examples of directional nozzles for use with valve subs.
Figure 3F:
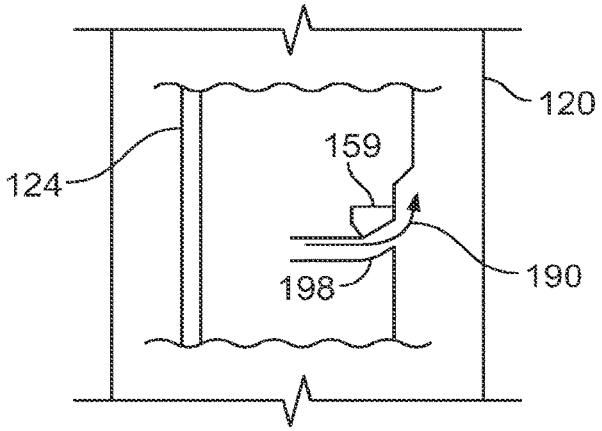

FIG. 3C shows one example of a valve sub 124 having a shear valve 158 wherein valve gate 182 may be controllably positioned in flow channel 183 to control flow of additive fluid 190 through port 159 into annulus 150 to mix with the return flow at that location. In the example shown in FIG. 3C, additive fluid 190 mixes with return fluid 131 resulting in modified return fluid 191. Modified return fluid 191 moves up annulus 150. Valve gate 182 may be driven by actuator 181. Actuator 181 may comprise an electric solenoid or other electric device capable of providing motion to valve gate 182, which may be single directional (e.g. circumferential) or bidirectional (e.g. linear or circumferential). Alternatively, actuator 181 may comprise a linear motor providing stepped type motion to valve gate 182. In yet another alternative, actuator 181 may be a hydraulic actuator, for example a hydraulic cylinder. Actuator 181 may include a biasing element such as a spring, or a structure such as a piston, to provide some or all the force required for motion of valve gate 182.

Figure 4:
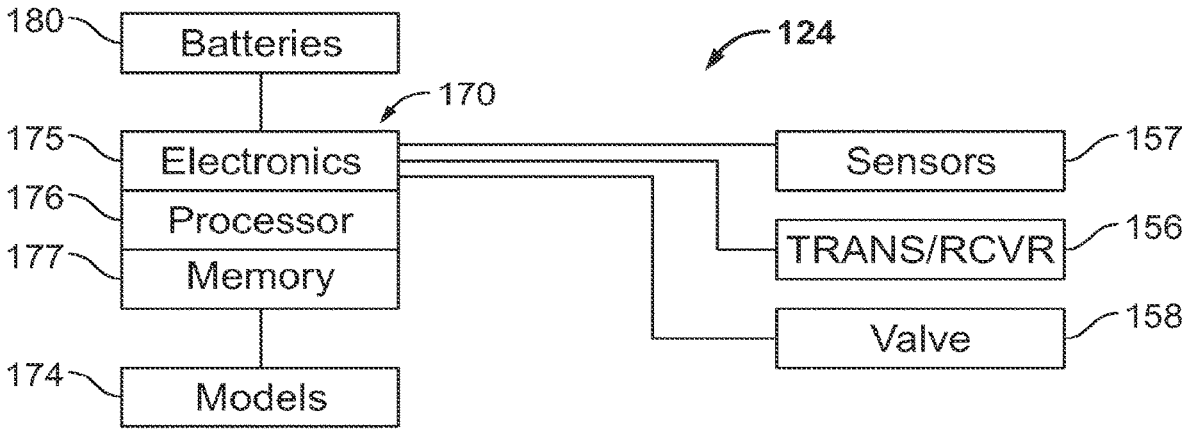
FIG. 4 shows a block diagram of one example of the components in valve sub.

FIG. 4 shows a block diagram of one example of the components in valve sub 124. In this example power source 180 comprises batteries known in the art. Alternatively, power source 180 may comprise a downhole generator instead of, or in addition to, batteries. In one example, a turbine nay be coupled to the generator and driven by the flowing fluid in drill string 122. In some examples electric power may be supplied from surface via a wireline within drill string 122 or via wired pipe. Power source 180 may also comprise storage capacitors. Valve sub controller 170 comprises electronic interface circuits 175 that power and interface with sensors 157, valve 158, and transmitter/receiver 156. Electronic circuits 175 are also in data communication with processor 176. Processor 176 is in data communication with memory 177. Processor 176 may act according to programmed instructions stored in memory 177 to receive signals from sensors 157 and determine a local property, which may comprise the density of the drilling fluid at that location. Other sensors may be located in valve subs 124 and may be used to determine local properties of the unmodified and modified return fluid including, but not limited to, fluid pressure, fluid temperature, fluid density, fluid flow rate, fluid flow velocity, flow rate of a particular phase, flow velocity of a particular phase, fluid resistivity, fluid pH, fluid viscosity, and fluid chemical composition, and operational performance of the return fluid at that location.

In one example, models 174 stored in memory 177 may be used to determine the appropriate desired fluid density at the location of a valve sub. The processor may actuate valve 158 to inject additive fluid 190 into the return fluid stream to adjust the density of the return fluid stream at selected locations along the annulus to match the model requirements. In one example, each valve sub may act autonomously to adjust the return fluid as it passes the location of each valve sub according to a predetermined model stored in the memory 177 resident in each valve sub. In one example, valve subs 124 are spaced approximately every 90-100 ft along the drill string 122. Any other suitable spacing may be used. Valve subs 124 may be spaced along drill string 122 for coverage of one or more particular hole sections, e.g. a vertical section, slant, curve, and/or horizontal section.

In another embodiment, each valve sub 124 communicates with at least one other valve sub, using suitable telemetry techniques, to transmit data and/or information indicating that changes are being made. Each other valve sub may then recalculate any adjustment necessary at each location along the drill string according to the model based at least in part on the data and/or information received from other valve subs.

As shown in FIG. 3C, in one example, two pressure sensors 157, separated by a vertical distance D (which in a non-vertical well section would be the true vertical component of the distance between the two pressure sensors) are disposed in valve sub 124. The two pressure readings may be used to determine the local density of the return fluid and/or modified return fluid as it passes a valve sub 124. For example, ignoring frictional pressure losses over the relatively short distance D between sensors, $$\rho_{fluid} = \frac{gD}{\Delta p} \tag{1}$$

where $\rho_{fluid}$ is the density of the local return fluid, $\Delta p$ is the pressure difference between the two sensors, and g is the gravitational constant. In an alternative example, a differential pressure sensor may be used with two sensing lines connected to a single sensor to reduce measurement uncertainties.

In one example, wired drill pipe may be used to provide a high speed communications channel along the network of valve subs 124, and optionally may provide power as discussed above. Wires may transit the drill string via tubing running along the interior wall of the drill pipe, or via tubing centralized in the drill pipe. Alternatively, a wireline and/or optical fiber may be run down the interior of drill string 122. In yet another alternative, a wired pipe network, using for example the Intelliserv® brand of wired pipe, may be employed, which may include inductive couplers at drill pipe connections. In one mode, each sub may act autonomously, and broadcast the actions taken on the communication channel for use by other valve subs. In another mode, using a high speed communication channel, the settings for one or more valve subs may be made by models located in surface controller 103 and settings for each such valve sub continuously transmitted to each affected sub, periodically transmitted to each affected sub, transmitted as need is determined by surface controller 103 and/or by a human operator. In addition, sensor readings from each valve sub 124 may be transmitted to surface controller 103 for updating each iteration of changes.

Alternatively, equation (1) may be used to determine the average fluid density between two separated valve subs 124, using measurements taken at approximately the same time. For example, in a prewired pipe example, a command may be initiated from either a master control module downhole, or a surface controller, for all or selected valve subs 124 to sense the local pressures and determine the local return fluid densities. Any of the controllers 170 in the downhole valve subs 124 may be designated as a master controller on the network of valve subs 124. Each valve sub 124 may be identified with an identification number and its known position along the drill string. The pressure measurement data may be transmitted to the downhole master controller or surface controller where it may be converted into a pressure gradient profile along the portion of the well where the measurements are made. The data may be compared to predicted or allowable pressure gradient values and/or predictive models located in the downhole master or surface controller. The appropriate valves may be actuated to dispense additive fluid 190 at the appropriate valve subs 124 to modify the density of the modified return fluid 191 along the appropriate sections of the wellbore to maintain a desired fluid pressure gradient in those sections, for example maintaining the gradient within the range above the local formation pressure but below the fracture pressure at locations along the wellbore.

Figure 5:
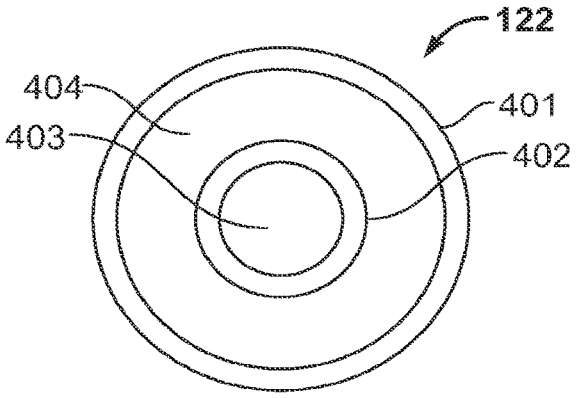
FIG. 5 shows an example drill string comprising a coaxial arrangement with nested flow channels.
Figure 6:
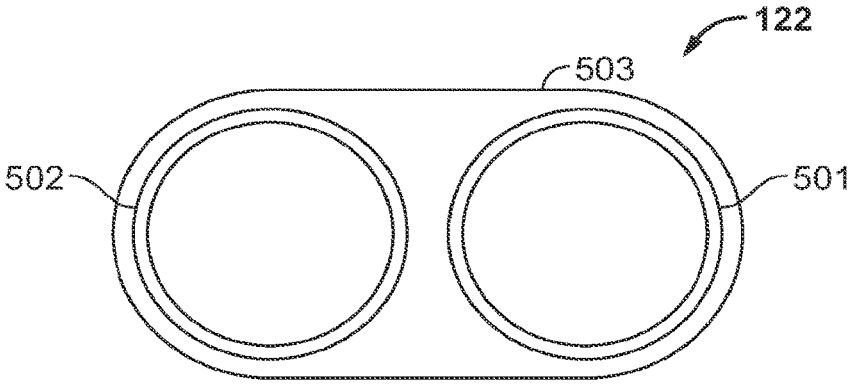
FIG. 6 shows an example drill string with parallel flow channels.

FIGS. 5 and 6 show examples of drill string 122. FIG. 5 shows a nested arrangement of flow conduits 401 and 402. As used herein, the term nested means that at least one smaller flow conduit is contained inside the bore of a larger flow conduit. In one example conduits 401 and 402 may be substantially parallel. In another example, flow conduits 401 and 402 may be substantially coaxial. Conduit 401 may comprise drill pipe, dill collars, and coiled tubing known in the art. While shown as substantially coaxial in FIG. 5, any other position of flow conduit 402 inside flow conduit 401 is to be considered within the scope of the present disclosure. Any suitable number of flow conduits 402 may be used within the geometry constraints of conduit 401. FIG. 6 shows substantially parallel conduits 501 and 502 run together side by side and fixed in orientation with template 503. The arrangement of FIG. 6 may be suitable for drilling with a drilling motor 144, see FIGS. 2-3B. Any other suitable arrangement and number of substantially parallel conduits may be used. The system described above may also be used during open hole completion.

Figure 7:
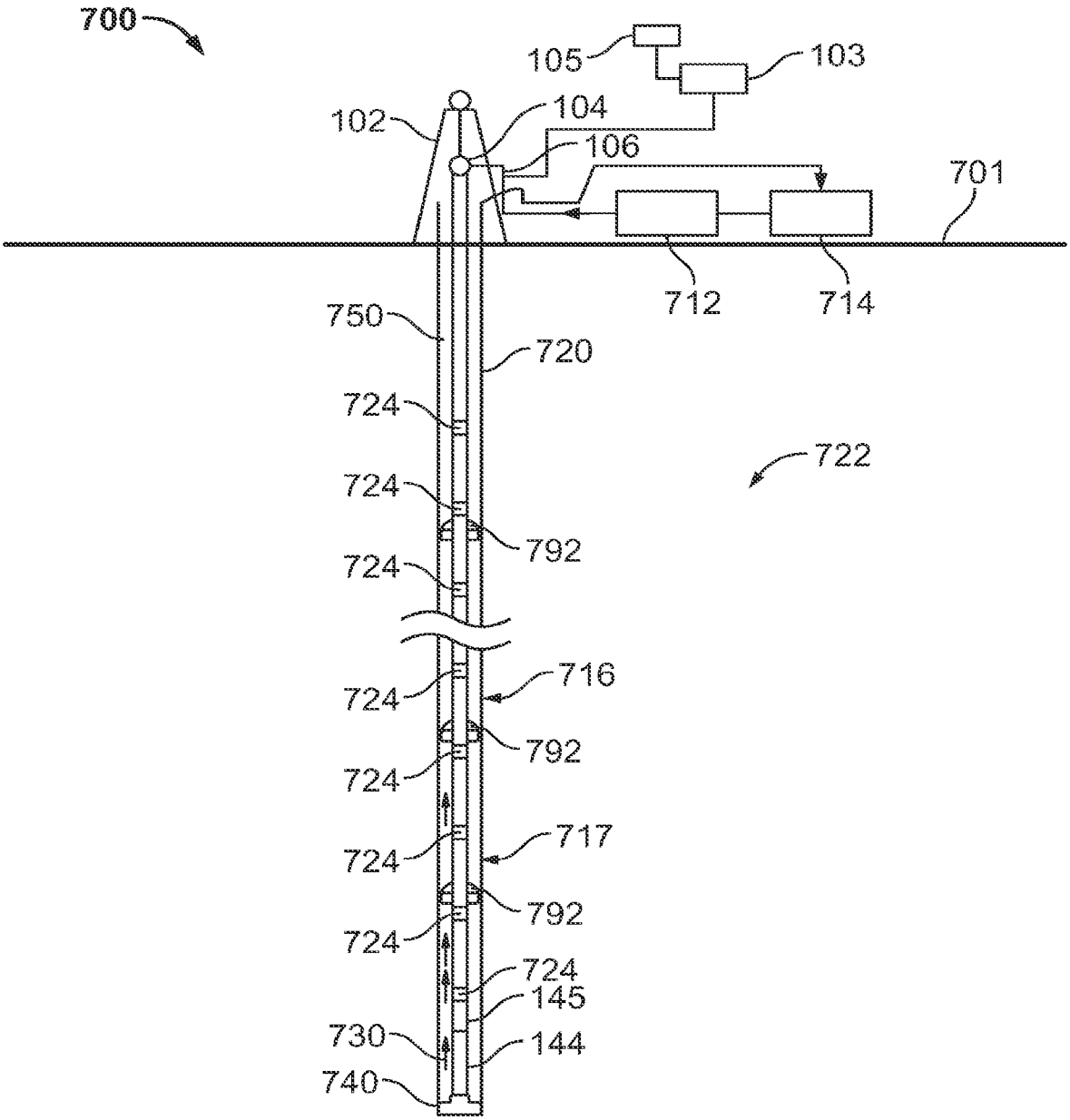
FIG. 7 shows another example of a drilling system.

In another embodiment, see FIG. 7, a drilling system 700 may provide multi gradient characteristics along the borehole 720. Drilling rig 702 is used to extend a drill string 722 into wellbore 720. Drill string 722 may comprise a drill pipe section 716 and a bottom hole assembly (BHA) 717. Drill string 722 may comprise standard drill pipe, drill collars, wired drill pipe, wired drill collars, coiled tubing, and combinations thereof. Drill pipe section 716 may comprise drill pipe sections 718 that may comprise wired pipe to provide bi-directional communication of data and/or power between the surface and downhole devices described herein. Wired pipe is commercially available, for example the Intelliserv® brand of wired pipe marketed by National Oilwell Varco. Any other suitable wired pipe may also be used.

BHA 717 couples to the bottom of drill pipe section 716 and may comprise a measurement-while-drilling (MWD) tool 145 comprising one or more MWD sensors, a drilling motor, a rotary steerable device, a drill bit 740, drill collars, stabilizers, reamers, and other common BHA elements.

In another embodiment, drill string 722 comprises a single channel axially extending conduit wherein a drilling fluid 730 flows down drill string 722 and exits the drill string to the borehole through openings in bit 740 which is attached to the bottom of drill string 722. As used herein, the term fluid comprises liquids, gases, liquid-solid mixtures, emulsions, and combinations thereof.

In some embodiments, drill string 722 is configured for wellbore activities other than drilling, and may be used without bit 740, in which case drilling fluid 730 may exit the drill string to the borehole through the bottom of drill string 722, or through another opening in drill string 722. In some embodiments drilling fluid 730 may comprise a fluid for other than drilling activities, for example a cement slurry, a displacement fluid, a completion fluid, a stimulation fluid, a gravel pack fluid, any other suitable wellbore fluid, and combinations thereof.

Drill string 722 may be run all, or partly, into a borehole, either existing or under construction, for example borehole 720, creating an annulus 750 between drill string 722 and the wall of borehole 720. Annulus 750 may be a return path for fluid pumped from surface into drill string 722. Borehole 720 may be all or partially cased along its length.

Those skilled in the art will appreciate that, in some embodiments, one or more flow return devices (not shown) may be used at, or near, surface 701 for controlling flow returns from the annulus, such devices including conventional blow out preventers, rotating control devices, and fixed or adjustable chokes. A pump or other fluid source may at times be hydraulically coupled to the annulus for purposes of circulating fluid down the annulus, or charging the annulus with pressure.

In some embodiments, sensors may be provided at or near surface 701, for making measurements of one or more of input and output fluids, and may comprise a pressure sensor, a temperature sensor, a flow sensor, a resistivity sensor, a pH sensor, an acoustic sensor, a chemical sensor, an optical sensor, and a nuclear sensor, and/or other suitable sensors, located at the standpipe, at a base fluid pump, at an additive fluid pump, upstream or downstream of a surface choke, and/or on a riser.

In one example, as shown in FIG. 7, a plurality of valve subs 724 are disposed at axially spaced apart locations in drill string 722. One or more valve subs 724 may be located within the BHA 717. One or more valve subs 724 may be located separate from and above the BHA in drill pipe section 716. Such drill pipe section valve subs 724 may be located in between sections of conventional drill pipe, or in between sections of wired drill pipe. Valve subs 724 may be internally ported to pass drilling fluid 730 through valve subs 724 onward through drill string 722 to bit 740. Valve subs 724 may also comprise an internal valve mechanism that controllably vents drilling fluid 730 into annulus 750 to adjust the pressure profile in annulus 750. By adjusting the pressure profile in annulus 750, a multi-gradient pressure profile may be generated along the annulus return path while maintaining a constant flow rate at the surface. In one example, the return drilling fluid 730 is returned to the surface to tank 114. Pump 112 pumps drilling fluid 730 downhole through drill string 722. Alternatively, when drilling fluid 730 comprises a gas or a gas/liquid mixture a suitable compressor may be provided instead of, or in addition to, pump 112.

Each valve sub 724 comprises a controllable valve 758 in fluid communication with at least one flow port 759 that is in fluid communication with return annulus 750. Each valve sub 724 also comprises at least one sensor 157, at least one communication transmitter/receiver 156, a valve sub controller 170, and a power source 180, all described previously with respect to FIGS. 3A, 3B, and FIG. 4. In one example, controllable valve 758 may comprise a shear valve. Alternatively, controllable valve 758 may be a poppet valve, a rotary valve, or any other suitable valve configuration. Alternatively, controllable valve 758 may be a burst plate, blowable plug, or other non-resettable flow control device. Controllable valve 758 may be a check type valve operable (to open or close) at particular pressure levels. Controllable valve 758 may be capable of full open/full close operation, may be capable of metering flow, and/or may be adjustable between two or more restrictions. In some embodiments controllable valve 758 may not have a fully-closed setting.

In one example, valve sub 724 may be a unitary sub, or a combination of subs which are coupled to drill string 722 and together comprise the aforementioned elements. Valve subs 724 may be located within the BHA 717, and/or along drill pipe section 716. In some examples, one or more of the aforementioned transmitter/receiver 156, controller 170, and power source 180 associated with a valve sub may be physically remote (for example up or down the drill string) from the valve sub 724, though still operably coupled (for example by wires) to the other elements of the valve sub as required for the operation described herein.

Flow port 759 may be similar to flow port 159 and be configured to direct fluid in a radial direction towards the borehole wall. In some embodiments, flow port 759 may comprise a directional nozzle that directs flow in a direction with a vector component at least partially parallel to the drill string, in an uphole or downhole direction, or in a direction with a vector component tangent to the circumference of the drill string similar to that described in FIGS. 3E and 3F. Flow port 159 may be configured to focus the exiting fluid in a narrow jet, or more broadly dispersed flow, or other flow cross section or profile. In some embodiments two, or more, flow ports 759 may be in fluid communication with a single controllable valve 758. The two, or more flow ports 759 may be arranged around the circumference of the drill string at a particular location along the length of the drill string, at a single circumferential orientation along the length of the drill string, with a defined offset in relative position along the length or orientation, or a combination of any of the foregoing. Flow port(s) 759 may be configured to direct fluid in a manner to control fluid impingement on the borehole wall, control flow jetting along the length of the borehole, and along the circumference of the drill string in a particular orientation of the drill string (which may be related to the orientation of the borehole), or to control flow mixing. Flow port(s) 759 may be configured for the fluid exiting the fluid port(s) 759 to help agitate and mix materials, for example, cuttings entrained in the annulus mud, mobilize cuttings along the bottom of a slant or horizontal section, provide a concentrated or evenly distributed material towards the borehole wall or into the annulus, remove material such as filter cake from the borehole wall, or to avoid one or more of the foregoing.

In one example, the at least one sensor 157 may comprise at least one sensor chosen from the group consisting of: a pressure sensor, a temperature sensor, a flow sensor, a resistivity sensor, a pH sensor, an acoustic sensor, a chemical sensor, an optical sensor, and a nuclear sensor. Valve sub controller 170 may also comprise a 2 axis or a 3 axis accelerometer sensor, a gyro, or inclinometer of any type, to determine the local inclination of valve sub 724 with respect to a vertically downward direction with respect to gravity. Valve sub controller 170 may also comprise an orientation sensor, which may utilize the aforementioned multi-axis accelerometers or gyro, or multi-axis magnetometers, to determine the local orientation of valve sub 724 or flow port(s) 759 with respect to the high side of the hole, and/or a compass heading. Transmitter/receiver 156 may comprise a single device performing both functions, or, alternatively may comprise a separate device for each function. Transmitter/receiver 156 may enable communication between the various valve subs 724. Transmitter/receiver 156 may also enable communication between a valve sub 724 and surface controller 103. Communications may be by mud pulse telemetry, EM telemetry, RF telemetry, acoustic telemetry, optical telemetry, hard wired telemetry, and combinations thereof.

Figure 8:
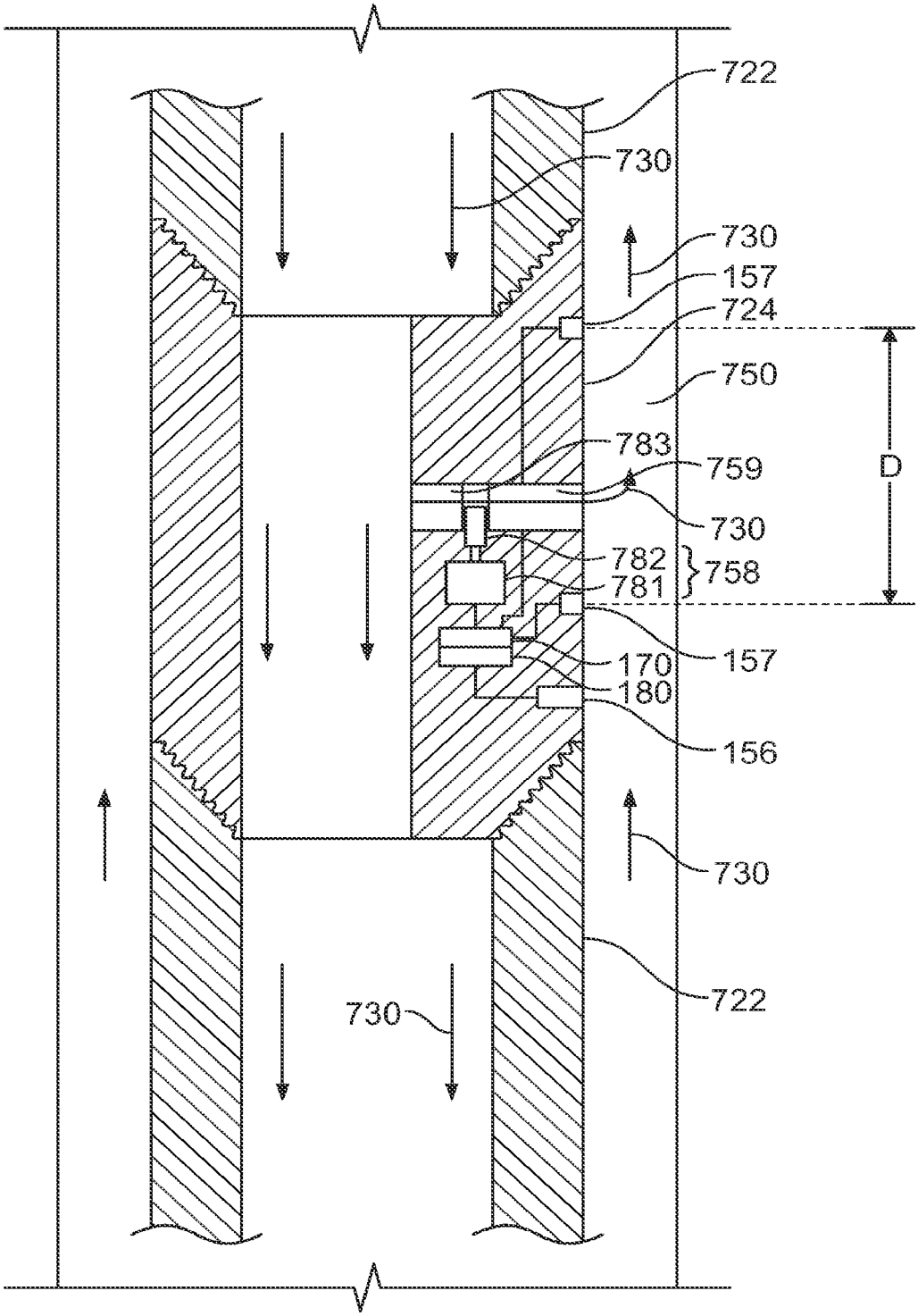
FIG. 8 shows one example of a valve sub.

FIG. 8 shows one example of a valve sub 724 having a shear valve 758 comprising a valve gate 782 that may be controllably positioned in flow channel 783 to control a flow of drilling fluid 730 through port 759 into annulus 750 to mix with the return flow at that location. Returning drilling fluid 730 moves up annulus 750. Valve gate 782 may be driven by actuator 781. Actuator 781 may comprise an electric solenoid or other electric device capable of providing motion to valve gate 782, which may be single directional (e.g. circumferential) or bidirectional (e.g. linear or circumferential). Alternatively, actuator 781 may comprise a linear motor providing stepped type motion to valve gate 782. In yet another alternative, actuator 781 may be a hydraulic actuator, for example a hydraulic cylinder. Actuator 781 may include a biasing element such as a spring, or a structure such as a piston, to provide some or all the force required for motion of valve gate 782.

In one example embodiment, at least one flow restrictor 792 may be disposed along drill string 722. Flow restrictor 792 may act to obstruct a portion of the return flow and increase pressure losses along the annular flow path, thereby increasing the equivalent circulating density (ECD) in the annulus upstream of flow restrictor 792. As used herein, upstream refers to the direction along the fluid flow path back toward the surface pump. Downstream refers to the direction along the fluid flow path towards the annulus exit at the surface. ECD is the effective fluid density that the formation sees when the flow loss pressure drop experienced by the fluids returning to surface is added to the fluid density. This increase in ECD acts to modify the pressure gradient in the effected region.

Figure 9A:
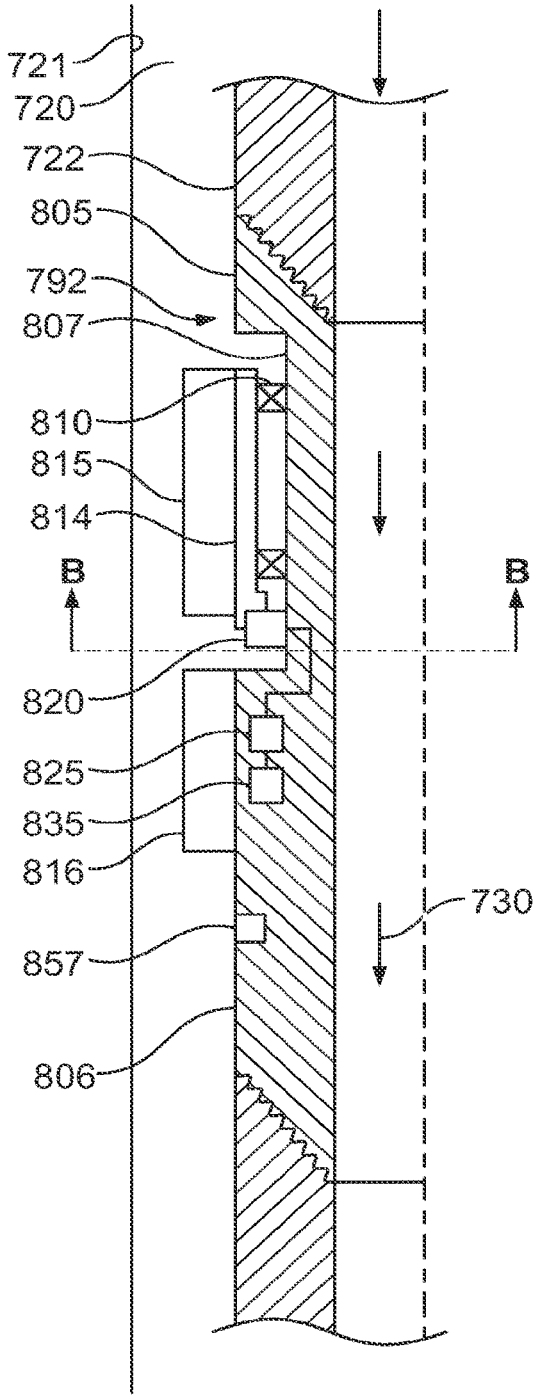
FIGS. 9A and 9B show one example of a flow restrictor.
Figure 9B:
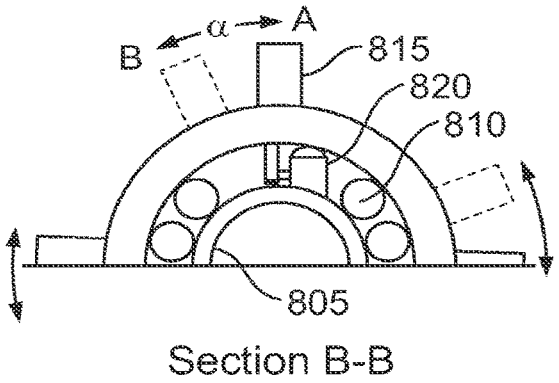

FIGS. 9A and 9B show one example of a flow restrictor 792 for modifying the ECD of drilling fluid 730. Flow restrictor 792 comprises mandrel 806 connected to connection end 805. Fixed blades 816 are attached to the lower end of mandrel 806. Blades 806 may be straight blades or spiral blades known in the art. Blades 806 extend outward from mandrel 806 toward the wall 721 of borehole 220. Mandrel 806 also comprises a reduced diameter section 807. Mounted on reduced diameter section 807 is a rotatable blade assembly 814 comprising at least one rotatable blade 815 attached thereto. Bearings 810 may be mounted between rotatable blade assembly 814 and reduced diameter mandrel section 807 and allows rotation of blade assembly 814 relative to mandrel 806. In the embodiment shown, there are the same number of rotatable blades 815 as there are fixed blades 816. The rotatable blades 815 are circumferentially spaced to substantially rotationally align at one rotational position with fixed blades 816, providing a first flow loss in the annulus. Rotational blade assembly 814 may be activated by actuator 820 to rotate over an angle α such that blades 815 may move to locations between positions A and B. One skilled in the art will appreciate that positions of blades 815 other than position A will provide increased fluid pressure loss, also called pressure drop, in the annular flow stream in annulus 750. The increase in pressure loss may be measured by pressure sensors 157 located in valve subs located along the drill string above and below flow restrictor 792. Alternatively, one or more pressure sensors 857 may be located in flow restrictor 792 to measure pressure in annulus 720 at flow restrictor 792. In one example, pressure sensor 857 is located upstream of flow restrictor 792. Actuator 820 may comprise an electric motor, a stepper motor, a hydraulic motor, and any other suitable mechanism for rotating blades 815. Controller 825 may contain a processor, memory, and directional sensors as described previously. Transmitter/receiver 835 enables communication between flow restrictor 792 and surface controller 103 using any of the telemetry techniques described herein. In one example, transmitter/receiver 835 enables communication with valve subs upstream and/or downstream of flow restrictor 792 to provide controllable closed loop actuation of flow restrictor 792 based on instructions stored in a memory in data communication with controller 825. Alternatively, flow restrictor 792 may act on commands transmitted from a model stored in a memory of a valve sub proximate flow restrictor 792.

In one embodiment, rotatable blades 815 may be positioned at any position between position A and position B. In another embodiment, rotatable blades 815 may be oscillated at a predetermined frequency and at a predetermined amplitude of oscillation. The amplitude of oscillation may be an angle between 0 and α degrees. The amount of flow restriction is related to the amplitude of the rotational movement of blades 815 and the duty cycle of the flow restriction. Duty cycle is intended to mean the percentage of time that the rotatable blades are frictionally exposed to the annulus flow. Models may be developed to calibrate the desired position for a desired change in flow loss. Such models may be programmed into controller 825. Alternatively, measurements may be made in situ to determine the appropriate positions. It is intended that the flow restrictor may be utilized with any of the embodiments described herein.

In one example, blades 815 may be spiral. Blades 815 may be driven to rotate by the return flow. In such flow-driven-rotation embodiment, blades 815 may be controllably engaged with a braking device, and may be used to maintain a controlled pressure drop over blades 815, or to maintain a controlled annulus pressure at a location. Flow restrictor 792 may comprise one or more of a sensor, actuator, controller, communication link to surface controller 103, and communication link to other downhole modules, as described in regard to valve subs 124 and 724.

Figure 19:
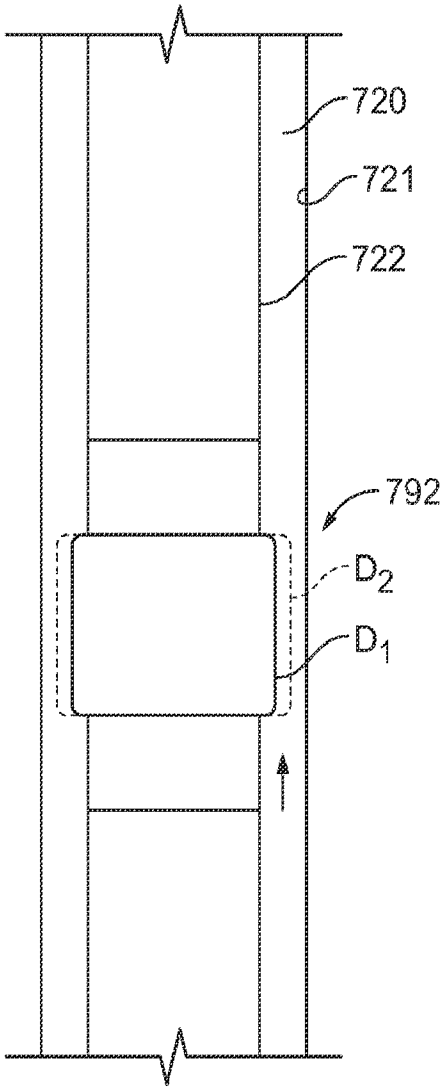
FIG. 19 illustrates another example of a flow restrictor.

In one example, see FIG. 19, flow restrictor 792 may comprise a controllably inflatable packer. Controllably inflatable packer may be actuated by mechanical and or hydraulic mechanisms known in the art to increase the packer diameter from a first diameter D1 to a second diameter D2. D2 may be any diameter between D1 and the diameter of the wellbore. Flow restrictor 792 may comprise one or more of a sensor, actuator, controller, communication link to surface controller 103, and communication link to other downhole modules, as described in regard to valve subs 124 and 724. The diameter of the controllably inflatable packer may be adjusted based on sensor measurements made downhole. The diameter may be adjusted to maintain a desired ECD upstream of the flow restrictor. Alternatively, the diameter may be adjustably controlled to maintain a desired pressure drop across the flow restrictor.

Figure 20:
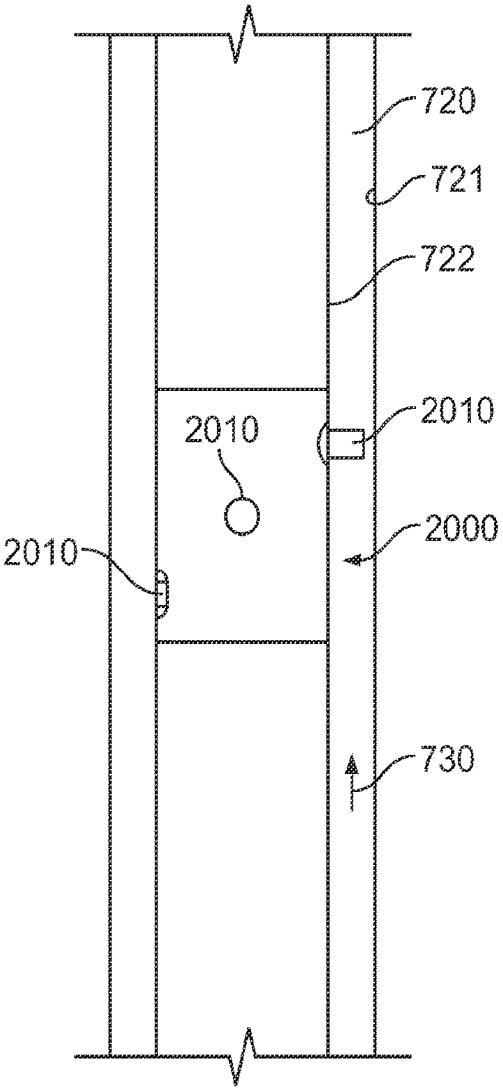
FIG. 20 illustrates yet another example of a flow restrictor.

In another embodiment, see FIG. 20, flow restrictor 2000 comprises controllably extendable pegs 2010 that may be extended into the return flow of drilling fluid 730 to increase flow restriction as described above with reference to flow restrictors 792. In addition, pegs 2010 may be extended into the return flow to induce additional turbulence into the return flow to enhance hole cleaning. Any number of pegs 2010 may be disposed around the circumference of restrictor 2000. Pegs 2010 may be extended using mechanical, electromechanical, and/or hydraulic techniques known in the art. Pegs 2010 may be axially located at a single axial location or spaced along the length of flow restrictor 2000, as shown.

Figure 10:
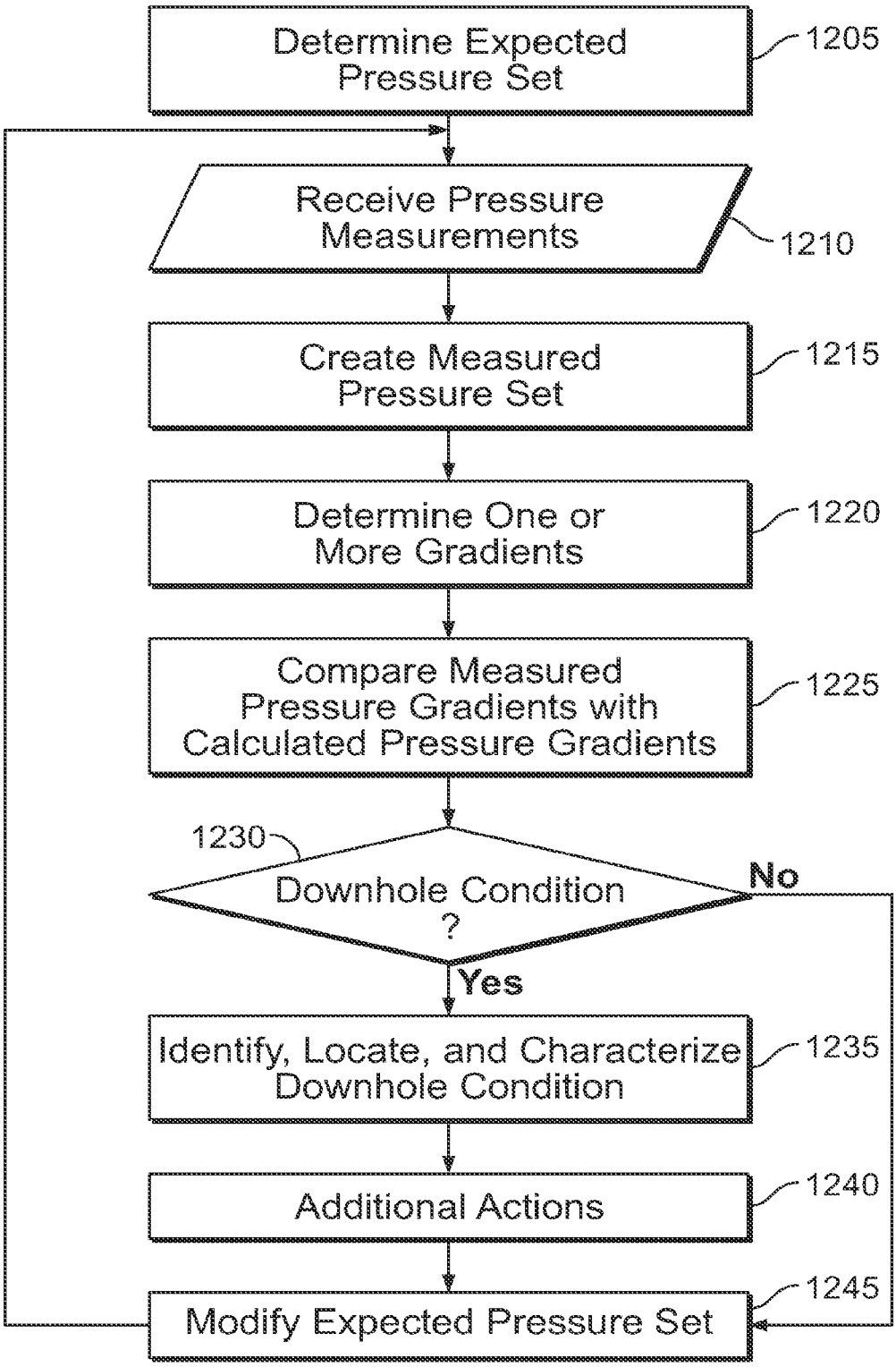
FIG. 10 shows an example flow chart for detecting downhole conditions based on one or more pressure measurements from one or more pressure sensors.

In some embodiments, one or more of valve subs 724 with port(s) 759 for venting base fluid to the annulus, one or more valve subs 124 with port(s) 159 for venting additive fluids to the annulus, one or more flow restrictors 792, and any combination of the foregoing may be operated in accordance with an example flow chart for detecting downhole conditions based on one or more measurements from one or more sensors 157 as shown in FIG. 10. Such measurements may be pressure measurements from pressure sensors or measurements from other sensors as discussed earlier.

In general, a downhole condition may include any regular or irregular, static or dynamic, condition or event along a round-trip fluid path. Example downhole conditions may include, but are not limited to, one or more of the following: a flow restriction, a cuttings build-up, a wash-out, and an influx. A flow restriction may include that from swelling shale. The processing and determining of a "downhole condition" may be done either by a surface processor, downhole processor, and/or human at surface. In one example, the processor 176 determines a set of expected pressure values (block 1205). The processor 176 receives one or more pressure measurements from the pressure sensors 157 (block 1210). The processor 176 may create a measured-pressure set from the pressure measurements received and may determine one or more measured-pressure gradients (blocks 1215 and 1220). The processor 176 may compare the measured pressure gradient profile with the expected pressure gradient profile (block 1225) to detect a downhole condition. If the processor detects a downhole condition, it may identify, locate, and characterize the downhole condition (block 1235). The processor 176 may perform further actions (block 1240), including, but not limited to, adjusting a density of the fluid in the return annulus, venting drilling fluid from the drill string to the return annulus, increasing a flow resistance in the return annulus, and combinations thereof. The processor 176 may perform such further actions by sending signals to one or more of controllers in valve subs 124 or 724, or controllers in restrictor subs 792, the respective controller causing a respective actuator to actuate a valve to adjust flow rate of an additive fluid, actuate a valve to adjust venting flow rate of a base fluid, or actuate a device to adjust the flow restriction of a flow restrictor. Regardless of whether the processor 176 detects a downhole condition (block 1230), it may modify the expected-pressure gradient set (block 1245) and may return to block 1210.

Creating the set of expected pressure gradient values (block 1205) may include receiving one or more expected pressures from an external source (e.g., a user, a database, or another processor). Creating the expected-pressure gradient set may include accessing simulation results such as modeling results. The modeling to create the expected pressure values may include hydraulics modeling. The hydraulics modeling may consider one or more of the following: properties of the borehole and drill string, fluid properties, previous pressure measurements from the borehole or another borehole, or other measurements. In some implementations an expected-pressure gradient set may be created by copying one or more values from a measured-pressure set. In other implementations an expected-pressure gradient set may be created by using values from a measured-pressure gradient set and adjusting or operating upon the values in accordance with an algorithm or model. Some implementations utilizing measured-pressure gradient sets in the creation of expected-pressure gradient sets may use measured-pressure gradient sets from a recent time window, an earlier time window, or multiple time windows. Certain example expected-pressure gradient sets may be derived from trend analysis of measured-pressure gradient sets, such trends being observed or calculated in reference to, for example, elapsed time, circulation time, drilling time, depth, another variable, or combinations of variables. In one example, a set of expected pressure gradient values may be generated from commercially available computer models, for example the WELLPLAN™ brand of hydraulics modeling software from Halliburton, Inc. Alternatively, any suitable hydraulics modeling techniques may be used.

The set of expected pressure values may include one or more pressure values at one or more depths in the borehole. The depths may be locations of interest within the borehole. A set of expected values may be provided or determined corresponding to all or a portion of the fluid flow path within the borehole. The set of expected pressure values may represent one or more pressure profiles. A pressure profile may include a set of two or more pressures, and a set of two or more depths, or ranges of depths, where each pressure corresponds to a depth or a range of depths. The pressure profiles may exist, may be measurable, and may be modelable along the continuum of fluid or fluids in the borehole along one or more fluid flow paths within the borehole and along one or more borehole/borehole hydraulic paths or circuits.

Example pressure gradient profiles may include one or more hydrostatic profiles. Other example pressure gradient profiles include one or more static pressure gradient profiles that may include losses. The losses may include frictional losses or major losses, where major losses are typically associated with cross sectional area changes (e.g., drill bit nozzles, mud motors, and surface chokes, flow restrictors such as flow restrictor 792 described above, flow ports 159). Other example pressure gradient profiles may include stagnation pressure profiles. The stagnation pressure gradient profiles may be related to flow velocity. Example pressure gradient profiles may include arithmetic or other combinations or superposition of profiles.

While drilling the borehole 120, the downhole processor 176 may change the expected-pressure set to reflect changes in the well. The processor 176 may change the expected-pressure set to reflect drilling progress (e.g. increasing depth). The processor 176 may alter the expected-pressure set to account for one or more known or unknown drilling process events or conditions. Changes to the pressure profile may be consistent or inconsistent with modeling, forecasts, or experience. Alternatively, surface processor 103 may change the expected set of pressure values and transmit them to the downhole processor 176.

The processor 176 may model or be provided hydrostatic pressures, hydrostatic profiles, and changes in hydrostatic pressure within the drill string or the borehole 120. The processor. 176 may model or be provided frictional pressures, frictional profiles, frictional losses, or frictional changes within the drill string or the borehole 120. The processor 176 may model or be provided with one or more stagnation pressures, stagnation pressure profiles, stagnation pressure losses, or stagnation pressure changes within the drill string or the borehole 120. The processor 176 may consider one or more factors impacting pressure including the dimensions of the drill string (e.g., inner and outer diameters of joints or other portions of the drill pipe and other drill string elements) and dimensions of the borehole 120. The processor 176 may also consider one or more depths corresponding to one or more measured pressures within the borehole 120. The processor 176 may consider drilling fluid properties (e.g., flow rates, densities, yield point, viscosity, or composition), one or more major loss sources (e.g., drill bit nozzles, mud motors, and surface chokes, flow restrictors such as flow restrictor 792 described above, flow ports 159), and whether one or more portions of the borehole 120 are cased or open hole.

The processor 176 may be provided with or calculate one or more depths when calculating the expected-pressure set. The depths may include one or more of the following: the true-vertical depth (TVD) (i.e., only the vertical component of the depth), measured depth (MD) (i.e., the direction-less distance from the start of the borehole or other reference point chosen such as ground level, sea level, or rig level, to the bottom of the borehole or other point of interest along the borehole), and the round-trip depth (RTD). In general, the RTD is the direction-less distance traveled by the drilling fluid. The RTD may be measured from the mud pumps or the start of borehole 120 (or another starting reference point) to the end of the drill string (e.g. the bit 140) and back to a return reference point. The return reference point may be the start of the borehole 120, the point where fluid in the return line reaches atmospheric pressure, or another point. The end of the drill string may or may not correspond to the bottom of the borehole 120. The processor 176 may be provided with or determine the TVD of the borehole 120 to determine the hydrostatic changes in pressure. The processor 176 may be provided with or calculate the measured depth (MD) of the borehole 120 to determine frictional and other pressure changes.

Figure 11:
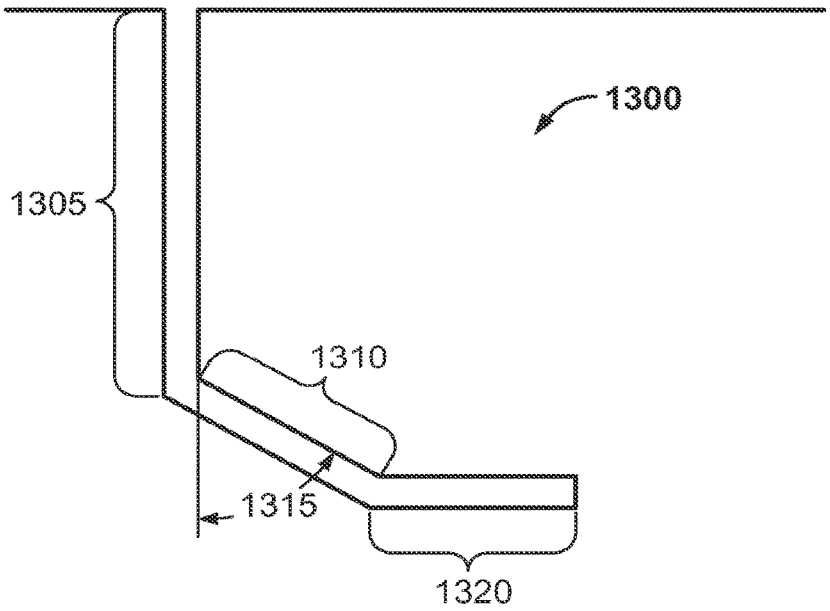
FIG. 11 shows an example of a deviated borehole.

An example borehole 1300 that may be modeled by a processor, for example downhole processor 176 and/or surface processor 103 is shown schematically in FIG. 11. The borehole 1300 includes a vertical segment 1305, a "tangent section" segment 1310 disposed to the vertical portion 1305 at angle 1315, and a horizontal segment 1320. A borehole 1300 with a cased vertical segment 1305 of 3000 feet, an uncased segment 1310 of 3000 feet, an angle 1315 of 60 degrees, and an uncased horizontal segment 1320 of 2000 feet will serve as the basis of upcoming examples. This example borehole description is simplistic, but demonstrative for purposes of discussing examples of the system. Actual boreholes may include other geometric features including 2-D and 3-D curve sections. The curve sections may form transitions between straight segments or the curve sections may take the place of one or more straight segments. Other example boreholes may include complex well paths. Other borehole features may be considered when modeling a borehole 1300. Such features may include inner and outer pipe diameters, hole diameters, formation types, and bit geometry. Pressure versus round-trip depth profile may be modeled. Such modeling may include inputs of pressure, flow rate, or other sensor measurements from surface or downhole as described herein. Such models may be updated in real time or near real time as additional sensor inputs become available.

Figure 12:
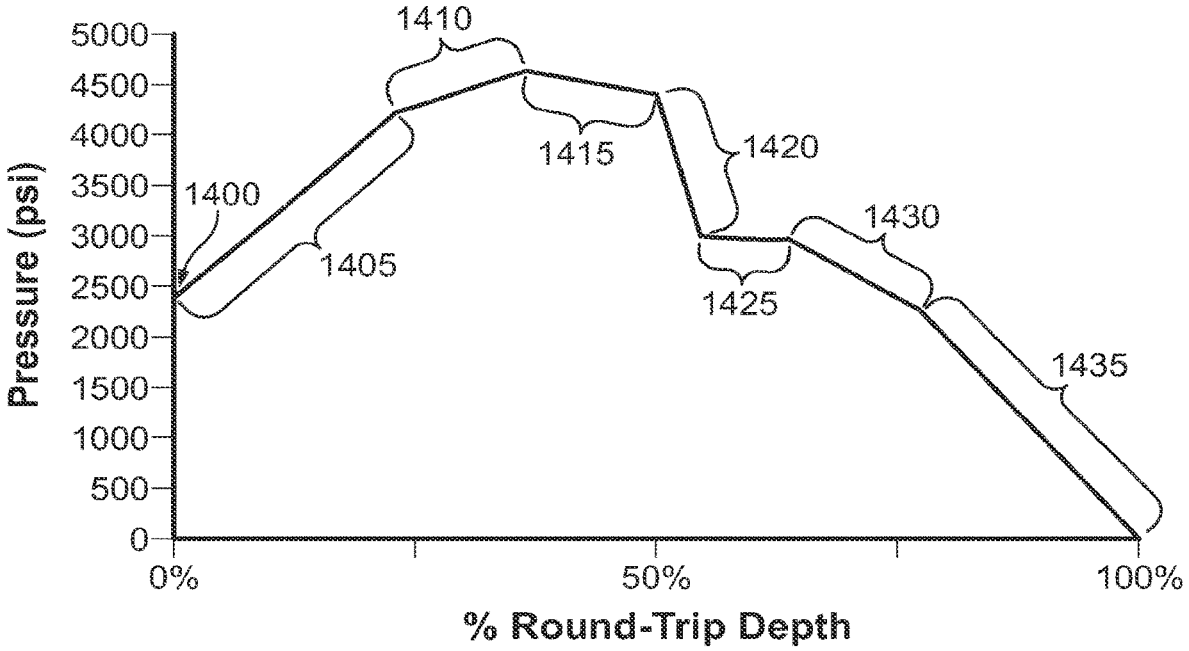
FIG. 12 shows an example of a predicted pressure vs. round trip depth for an example borehole.

An example expected-pressure set based on borehole 1300 is shown in FIG. 12. The lines shown in FIG. 12 may represent underlying data points (e.g., pressure-versus-depth). This example expected-pressure set assumes a constant flow rate and constant drilling fluid density though the entire round-trip distance, although such constancy is not always the case in practice and is not a limitation. The expected-pressure set shows static pressure, including hydrostatic pressure, versus the percentage of round-trip distance. Standpipe pressure 1400 is the pressure within the drill string at zero depth. Pressure segment 1405 represents the pressures in the drill string through the vertical borehole segment 1305. Pressure segment 1410 represents pressures within the drill string through the 60 degree borehole segment 1310. Pressure segment 1415 represents pressures within the drill string through the horizontal borehole segment 1320. Pressure segment 1420 represents pressures through BHA elements. In this example, the BHA elements include MWD/LWD tools, a rotary steerable tool, and drill bit. Pressure segment 1425 represents the annular pressure (i.e., the pressure outside the drill string) through the horizontal borehole segment 1320. Pressure segment 1430 represents the annular pressure through borehole segment 1310. Pressure segment 1435 represents the annular pressure through the borehole segment 1305.

Several example methods of using one or more of the devices described herein are described below in context of borehole 1300 as examples of the invention, which are extendable to other boreholes which may be more complex, and are not intended to be limiting.

Figure 13:
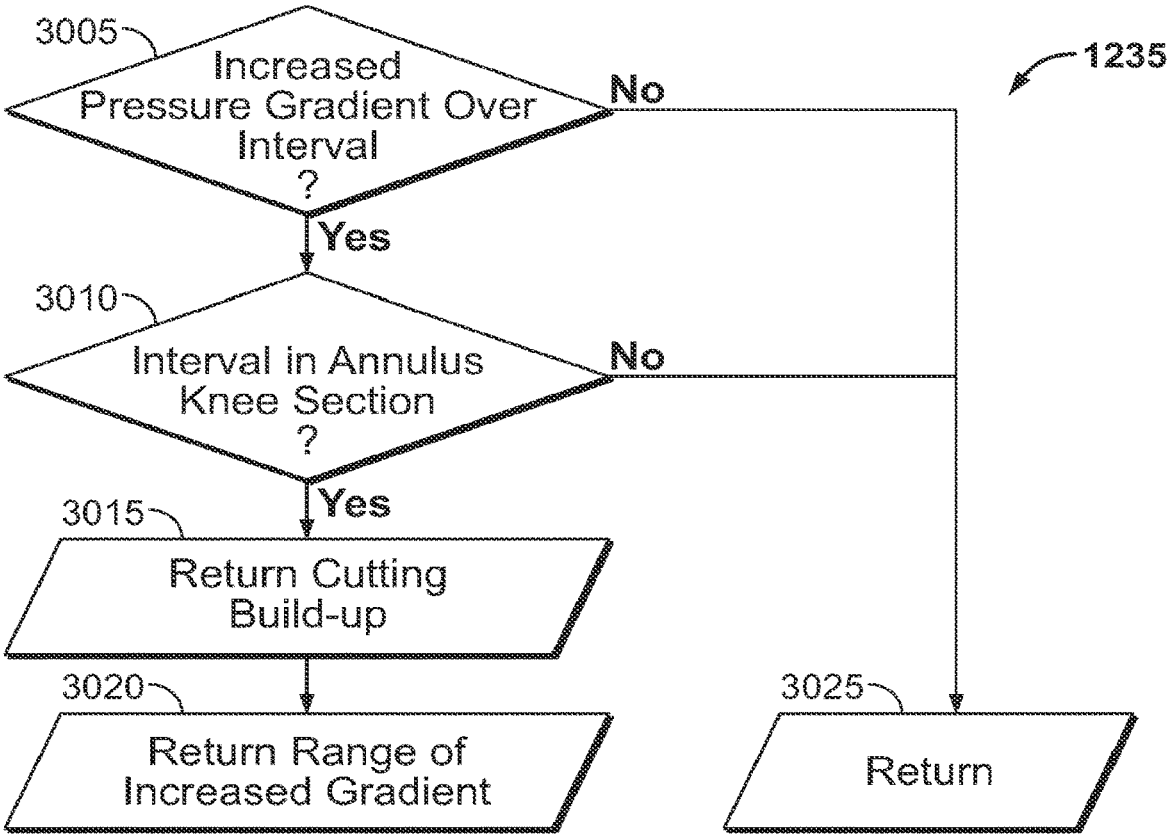
FIG. 13 shows a block diagram of a system for identifying and locating a downhole condition.
Figure 14:
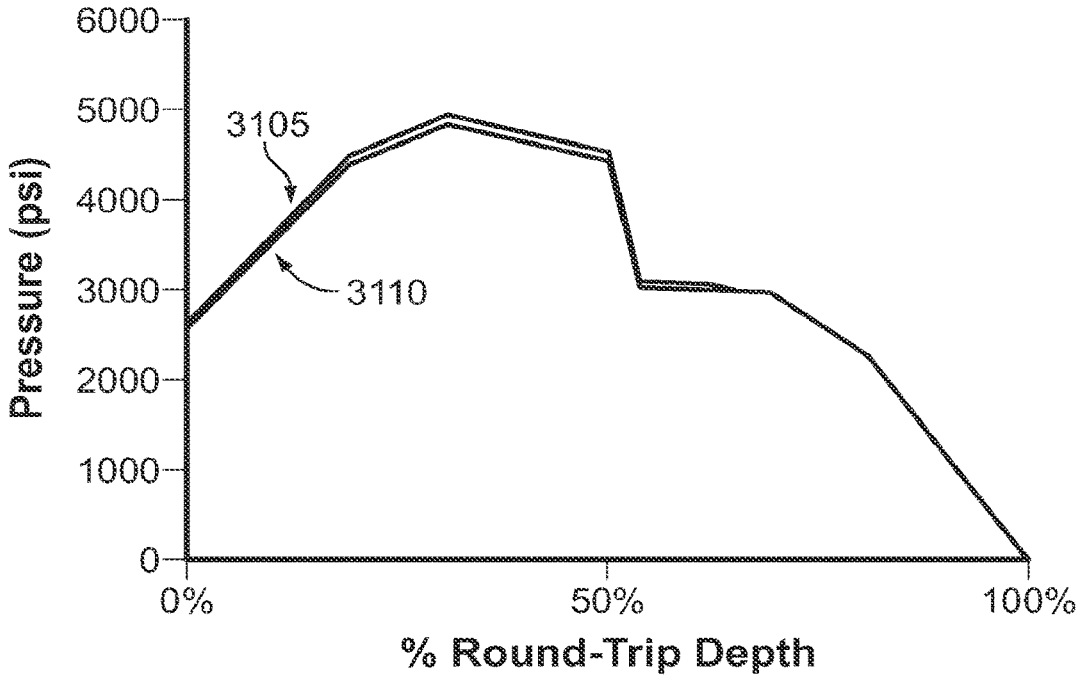
FIGS. 14-15 illustrate pressures versus depth for model value sets.
Figure 15:
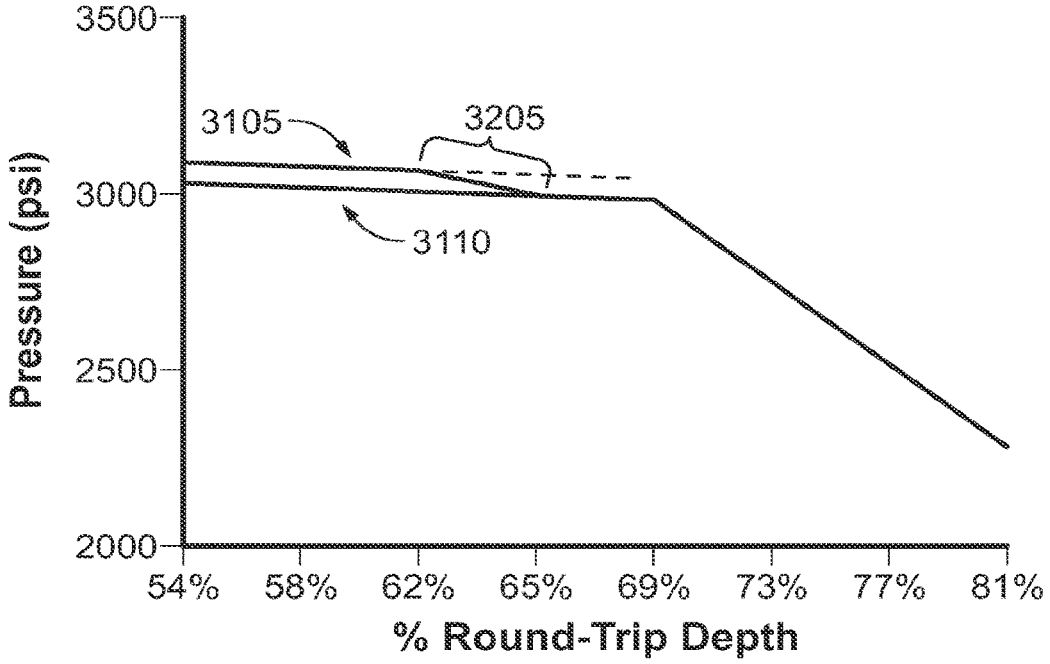

An example for identifying, locating and characterizing a downhole condition (block 1235, FIG. 10) is shown in FIGS. 13-15. A cuttings build-up may be identified as an annulus obstruction over an interval. Further analysis may more specifically indicate that the obstruction is likely to be a cuttings build-up. The processor, which may comprise downhole processor 176 and/or surface processor 103, may determine if there is an increased pressure gradient over an interval (block 3005). If so, and if the interval is in a particular borehole section known to be susceptible to cuttings build-up, such as the "knee" section in the annulus (i.e., where the horizontal section transitions to the 60 degree section, see FIG. 11) (block 3010), the processor may return "CUTTING BUILD-UP" as the likely identification of the downhole condition (block 3015) and may return a likely range of the increased measured gradient as the location of the condition (block 3020). Otherwise, the processor may return nothing (block 3025).

An example measured-value set (3105) and expected-value set (3110) demonstrating the cutting build-up condition is shown in FIGS. 14 and 15. FIGS. 14 and 15 show a pressure (including hydrostatic pressure) versus round-trip distance representations of the sets. FIG. 15 is scaled to show the location of the range of increased measured-pressure gradients.

Using the data shown in FIGS. 14 and 15 the processor may observe increased pressure gradients over an interval 3205 (FIG. 15) (block 3005) and determine that the interval is in the knee between the borehole sections 1310 and 1320 (block 3010). Based on these observations, the processor may identify the condition as a likely cutting build up in the annulus (block 3020) and locate the condition at the range of increase measured-pressure gradients (block 3025).

As indicated above, one or more pressure sensors 157 may measure annulus static pressures and based on these pressure measurements, models in downhole processor 176 and/or surface processor 103 may determine that the increased pressure gradient in the interval 3205 reflects increased pressure losses over the interval, which may reflect the increased annular flow velocity and likely cuttings build up. At least one valve sub 724, and in some cases multiple valve subs 724, may be set up to agitate and mobilize cuttings in the borehole, for example in one or more of a horizontal section or the "knee" of the curve section to at least partially alleviate this build up condition. The valve sub(s) 724 may be configured, and the drill string oriented, so as to vent a portion of the base flow to the low side of the hole where a cuttings bed may be forming, and to direct the vented flow with a flow vector component along the drill string in the direction of the return flow, for example using jets as described in FIGS. 3E and 3F. Two pressure sensors straddling a portion of the horizontal section may sense a higher pressure gradient than predicted by the model, indicating cuttings build up. One or more valve subs 724 may be used to vent drilling fluid to the return annulus to agitate the cuttings.

Alternatively, two or more valve subs 724 may be used simultaneously to vent fluid. Two or more valve subs 724 may be used sequentially to vent fluid, which may allow conserving of the available flow and pressure while, section by section, mobilizing cuttings and/or urging them along the annulus towards the surface. The valve subs 724 may be configured prior to tripping the string into the hole, or adjusted while in the hole (e.g. using a variably adjustable valve), to result in at least two different venting flow rates from at least two valve subs, adjacent to at least two different locations of the borehole. In this manner, and in accordance with a model or informed by the directly measured results (e.g. from pressure, caliper, or other sensors), the flow entering the drill string at surface can be allocated amongst the bit, and at least two valve subs to enhance hole cleaning.

In another example at least one valve sub 124 may be used to discharge additive fluid 190 into the annulus. In some examples, the additional flow of additive fluid 190 may increase the flow rate and flow velocity in the annulus to enhance hole cleaning.

Figure 16:
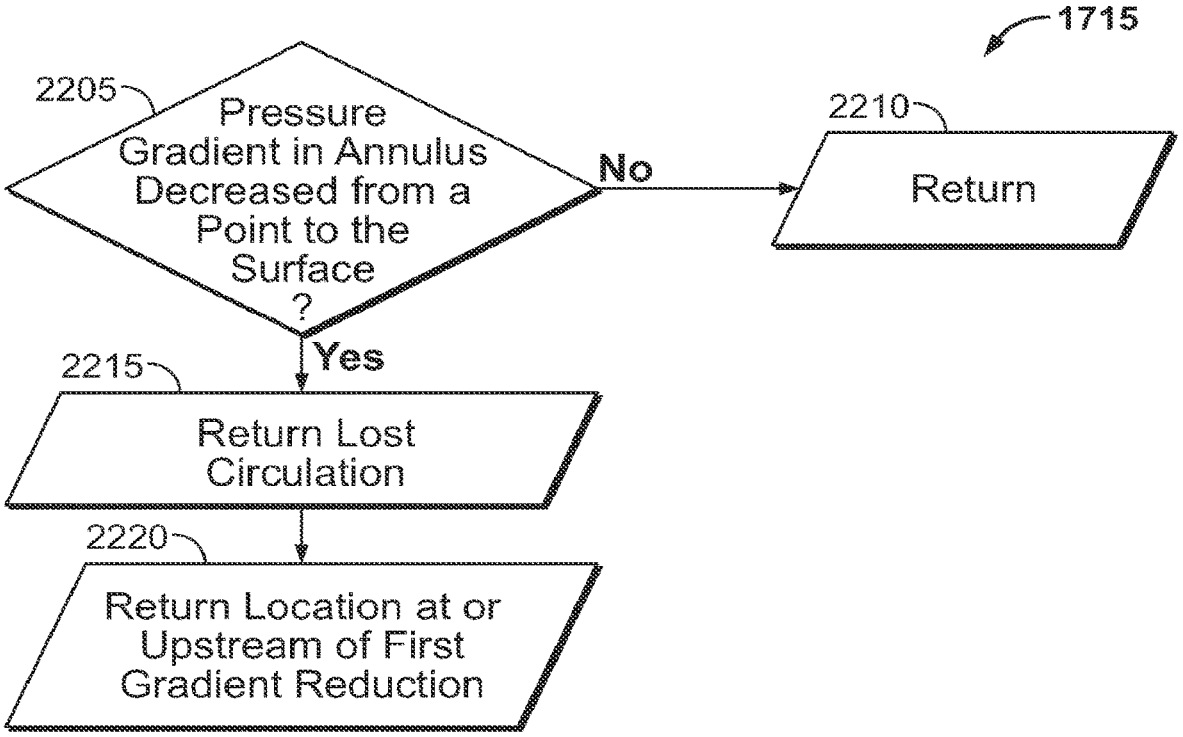
FIG. 16 shows a block diagram of a system for identifying and locating a downhole condition.
Figure 17:
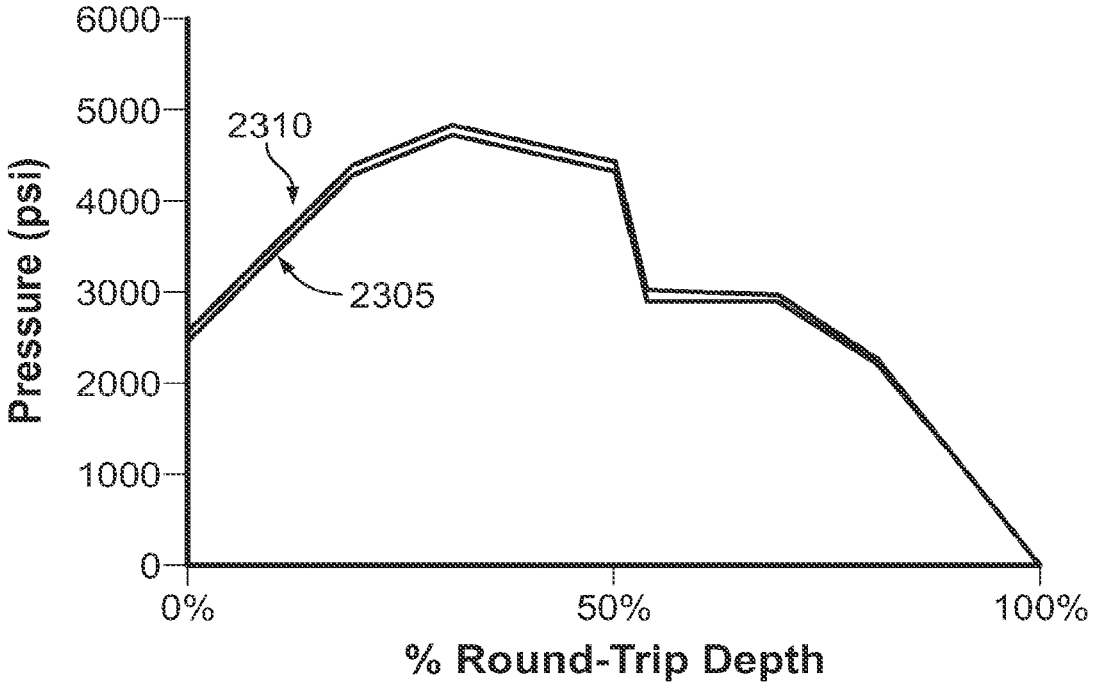
FIGS. 17-18 illustrate pressures versus depth for model value sets.
Figure 18:
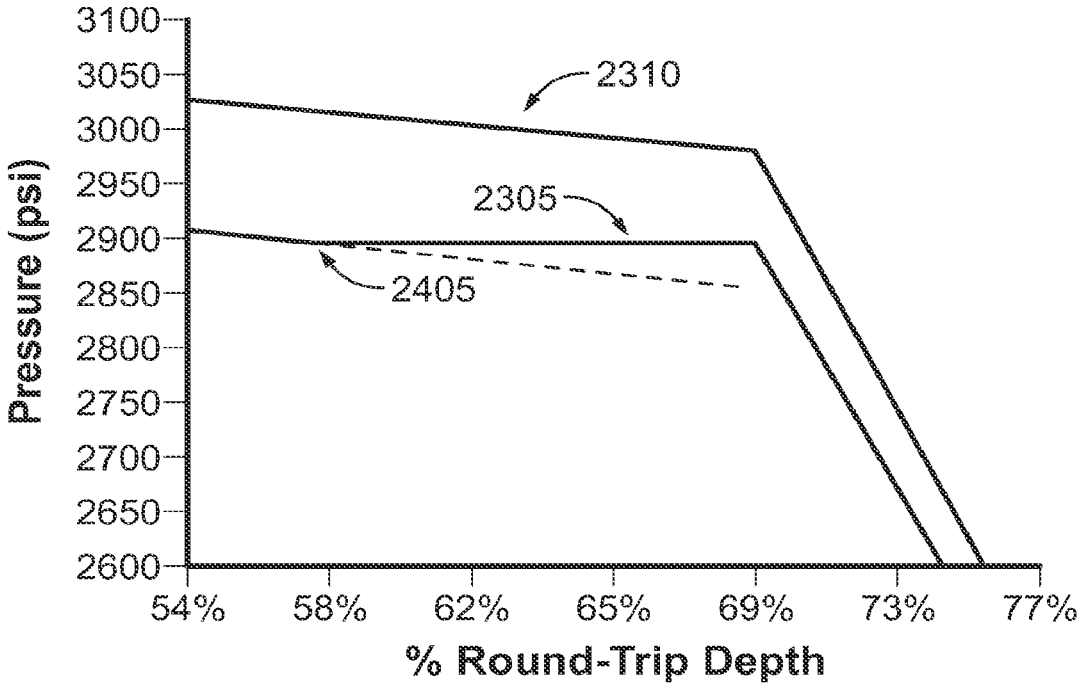

Another example for identifying, locating and characterizing a downhole condition (block 1235, FIG. 10) is shown in FIGS. 16-18. In a lost circulation condition a total flow rate from upstream of the lost circulation location or zone along the annulus return path may be divided, with all or a portion of the circulation being lost to the formation, and the remainder continuing downstream along the intended return path to surface. Pressures and pressure gradients may change accordingly from the expected (e.g., non-lost circulation condition). For example, a flow loss pressure gradient may be reduced downstream of a lost circulation zone. A processor, downhole processor 176 and/or surface processor 103, may determine if there is a measured-pressure gradient in the annulus that is decreased from a point to the surface (block 2205) and, if so, the processor may return "LOST CIRCULATION" as a likely identification of the downhole condition (block 2215) and may return a location at or upstream of the first measured gradient reduction as the location of the condition (block 2220). Otherwise, the processor may return nothing (block 2210).

An example measured-value set 2305 and expected-value set 2310 demonstrating a likely lost-circulation condition is shown in FIGS. 17 and 18. FIGS. 17 and 18 show a pressure (including hydrostatic pressure) versus round-trip distance representations of the sets. FIG. 18 is scaled to show the location of the inflection point in the measured-pressure gradient.

Using the data shown in FIGS. 17 and 18, the processor may observe a measured-pressure gradient decrease at inflection point 2405 in FIG. 18 (block 2205). In FIG. 18, the change in gradient is highlighted by the broken line. Based on this observation, the processor may identify the condition as a lost circulation zone (block 2215) and locate the condition at or upstream of the inflection point 2405 (block 2220).

One or more valve subs 124 may be located proximate the identified lost circulation zone to controllably discharge an additive fluid to reduce and/or stop the return fluid loss into the formation. The additive fluid may comprise lost circulation material known in the art. Alternatively, the additive fluid may comprise a cement to locally seal the formation.

In another example, multiple downhole conditions may be present. In one such example, at least one valve sub, for example valve sub 724, may be used to on-command vent drilling fluid to the annulus. Prior to such venting a constant steady state flow rate may be assumed along the entire flow path. A downhole condition, for example lost circulation, near bottom hole may be sensed, or a model may determine potential for a downhole condition, necessitating reduction of bottom hole pressure in the horizontal section. Hole cleaning or other requirements may, however, necessitate continued full flow of drilling fluid up the curve section 1310 and vertical section 1305 annulus. One or more valve subs 724, may be included in the drill string and one valve sub 724 may be situated below the curve section of hole. By venting and/or metering flow to the annulus using the particular valve sub 724, a portion of the drilling fluid bypasses that portion of the drill string below that valve sub, the mud motor, the bit, and the portion of annulus below that valve sub. The full flow combines above that valve sub and continues at full flow rate to surface. The flow pressure losses along the horizontal section are reduced, thus lowering the ECD near bottom.

In yet another example, a portion of the drill string may be differentially stuck, or the well-bore may have caved in on the drill string. The multiple valves and multiple flow channels of the system described above may be manipulated to alleviate these conditions. For example, a valve below the stick point may be opened and a valve above the stick point may be opened to restore fluid communication with the bottom of the wellbore. For example, fluid may then be pumped down a first channel in the drill string and back up the annulus to the first valve where it enters the second flow channel. In one option, the return flow may continue to the surface in the second flow channel. In another option, a second valve may be opened above the obstruction such that the return flow bypasses the obstruction through the second flow channel, and then reenters the annulus to return to the surface. In one example, a packer fluid may be pumped to the lower portion, below the obstruction, to maintain the integrity of the lower portion of the wellbore while the upper part, above the obstruction, is being repaired.

Figure 21:
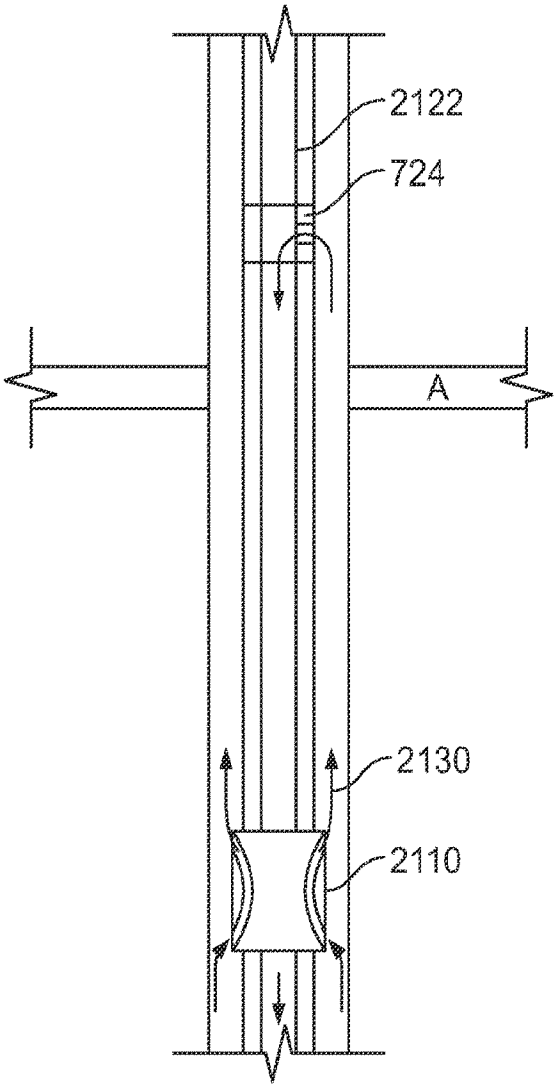
FIG. 21 shows an example drill string having a submersible pump disposed therein.

In one example, it may be desirable to maintain a pressure in a particular region along the annulus, for example, to hold back formation fluids. The apparatus and methods described above may be used to develop the appropriate pressure region during fluid flow. When the flow is stopped, for example to add a joint of pipe to the drill string, the fluid flow portion of the ECD is removed. In one example, flow restrictor packers 792 may be used to seal off around the zone of interest and maintain the desired pressure. In another example, see FIG. 21, a downhole submersible pump 2110 may be disposed in drill string 2122 at a point below the zone A of interest. Pump 2110 increases the ECD of the annulus fluid 2130 to the desired level to prevent influx from zone A during the connection. A valve sub 724 in drill string 2122 above the zone A may be opened during the connection to provide a downhole circulation for the fluid 2130. After the connection, valve 724 may be closed and pump 2110 shut down until the next flow stoppage.

In certain embodiments of the invention, a pore pressure value and/or fracture pressure value for a depth or location along the wellbore may be determined during well planning or during the drilling process. A pore pressure gradient and/or fracture pressure gradient (said gradients corresponding to a depth range) may likewise be determined in the planning or drilling process. These determinations may be on the basis of modeling as is known in the industry, and/or with the benefit of actual measurements from offset wells or the current well being drilled. These pore pressure and fracture gradient values determined may represent desired boundaries for the actual pressure in a formation zone in order to enhance the drilling process from a safety and efficiency standpoint. The pore pressure values or gradients may represent return annulus pressures at which formation fluids may be expected to flow into the wellbore (i.e. an influx). The fracture pressure values or gradients may represent annulus pressures at which the formation may be expected to fracture. The pore pressure and fracture pressure values and gradients along the wellbore, taken together, may represent a desired pressure (or pressure gradient) window in which to target drilling and other operations annulus pressure parameters. This window may reflect the actual determined boundaries, or modified boundaries. Such boundaries may be modified based upon additional modeling data, actual influx and other data from drilling, and may be further adjusted to include a factor of safety.

Once established, or updated, a pore pressure and/or fracture gradient value, or a pressure window comprising both, may be used as a target for comparison of actual measured pressures at corresponding depths. Pressure and/or other properties described previously may be measured from sensors proximate to, downstream, and/or upstream, of a flow restrictor 792 and/or fluid valve 124, 724 as described herein. These measurements may be taken during actual drilling; during circulation of mud with the bit off bottom, which may be with or without rotation of the drill string; during a period of flow stoppage (such as while connection is being made); while moving pipe up or down; and/or while tripping. There may be expected parameters (e.g. pressures or pressure gradients) for a section of the borehole corresponding to each of these activities, or transitions from one activity to another. For example, moving the pipe downward from surface may result in a surge of annular pressure, and moving it upward may result in a "swab" or transient pressure reduction. Drilling or rotation off bottom may mobilize cuttings, increasing effective fluid density, and therefore pressure. Increasing circulation rate from surface may increase annular pressure. Adjusting of a surface choke, and/or adjusting mud density, would result in changes to expected annulus pressures. During any of these activities, and in a transition from one such activity to another, a property, such as the fluid pressure in the annulus, of any particular section of the wellbore may be measured using the sensors, distributed along the drill string as described above, and the measurement may be compared to a target value in relation to pore pressure, fracture pressure, associated gradients, and parameter windows. A change in the property in that wellbore section may be desired for enhanced drilling or well operations. In one example, it may be desirable to bring the annulus pressure and/or ECD in such section to a value below the fracture pressure or gradient, above the pore pressure or gradient, or to a different value within a target window. In order to change the property more towards the desired value, a valve and/or flow restrictor, described above, proximate to, or downstream along the annulus, of the wellbore section of interest, may be actuated as described earlier. This decision may be a simple on/off or open/close, or may be for a particular actuation value for a valve or flow restrictor. Such values may be manually input, or may be determined by a downhole and/or surface processor. This determination may be made using a hydraulics or other model, and/or on the basis of past actuation values and results. A command may be communicated by a human operator, or may be automatically communicated from the surface processor, to the valve and/or flow restrictor, which may then actuate accordingly. In one example, a command may be communicated from the downhole processor, to the valve and/or flow restrictor, which may then actuate accordingly. This pressure, or another property, may be measured again and compared to the desired value. This process may be repeated, potentially in accordance with a control algorithm, in order to more closely achieve the desired target value of a downhole and/or surface property. It may be repeated continually over time, with the target values changing with depth, model conditions, or other factors, to maintain properties, for example pressure in a hole section of interest, over an extended period of time. This control process is not limited in its implementation to just downhole flow restrictors and valves. Other elements that influence the property of interest of the hole section, including, but not limited to, surface chokes and pumps, also may be controlled, in a coordinated manner with the control of the downhole flow restrictors and valves, to influence one or more parameters of interest for one or more hole sections.

The present invention is therefore well-adapted to attain the ends mentioned, as well as those that are inherent therein. While the invention has been depicted, described and is defined by references to examples of the invention, such a reference does not imply a limitation on the invention, and no such limitation is to be inferred. The invention is capable of considerable modification, alteration and equivalents in form and function, as will occur to those ordinarily skilled in the art having the benefit of this disclosure. The depicted and described examples are not exhaustive of the invention. Consequently, the invention is intended to be limited only by the spirit and scope of the appended claims, giving full cognizance to equivalents in all respects.

What is claimed is:

1. An apparatus comprising:

a plurality of valve subs spaced at intervals along a drill pipe section of a drill string in a wellbore, the plurality of valve subs being in hydraulic communication with a base fluid and an additive fluid in the drill string and a return fluid in an annulus in the wellbore, wherein the drill string further comprises a first axially extending flow channel having the base fluid and a second axially extending flow channel having the additive fluid, wherein a first valve sub of the plurality of valve subs comprises a master controller having a processor and a memory, and wherein the master controller is operatively coupled with the first valve sub and each of the other valve subs to electronically actuate at least one of a first and a second valve of at least one of the first valve sub and the plurality of valve subs to selectively discharge, at least a portion of, the base fluid and the additive fluid from inside the drill pipe section into the annulus to change at least one parameter of interest of the return fluid.

2. The apparatus of claim 1, wherein the master controller is operable to determine a measured pressure gradient based on measurements received from the plurality of valve subs, and to compare the measured pressure gradient to a model pressure gradient stored by the master controller, and wherein the master controller is operable to actuate each of the plurality of valve subs to dispense additive fluid and modify the density of the return fluid to maintain a desired fluid pressure gradient in the wellbore.

3. The apparatus of claim 1, wherein the first axially extending flow channel exits the drill string at a drill bit and the second flow channel is nested in the first flow channel, wherein the plurality of valve subs controllably discharge a portion of additive fluid from inside the second flow channel to the annulus at a plurality of locations uphole from the drill bit to modify the equivalent circulating density of the return fluid, and wherein each of the plurality of valve subs comprises a base fluid flow channel operatively coupled to the first flow channel of the drill string, and an additive fluid flow channel operatively coupled to the second flow channel of the drill string.

4. The apparatus of claim 1, wherein each of the plurality of valve subs is coupled to a common communications channel.

5. The apparatus of claim 1, wherein each valve sub is operable to broadcast the operation actions taken by such valve sub on the communications channel.

6. The apparatus of claim 1, wherein each valve sub is operable to receive a broadcast communication from another valve sub, such broadcast communication including a record of the actions taken by such other valve sub.

7. The apparatus of claim 1, wherein a setting for each of the plurality of valve subs is selected based on a model stored at the master controller.

8. The apparatus of claim 1, wherein a first valve sub of the plurality of valve subs is operable to receive a communication of an equivalent circulating density from a second valve sub, and wherein the first valve sub is operable to determine the average equivalent circulating density of the wellbore between the first valve sub and the second valve sub based on the received equivalent circulating density and a local equivalent circulating density measurement determined by such first valve sub.

9. A method of operating a valve sub, the method comprising:

operating a master controller comprising a processor and a memory to:

electronically actuate at least one of a first and a second valve of a plurality of valve subs to selectively discharge, at least a portion of, a base fluid and an additive fluid from inside a drill pipe section into an annulus to change at least one parameter of interest of a return fluid, wherein the master controller is positioned within a first valve sub of the plurality of valves subs, and operatively coupled to each of the plurality of valve subs, wherein the plurality of valves subs are spaced at intervals along a drill pipe section of a drill string in a wellbore, the plurality of valve subs being in hydraulic communication with at least one of the base fluid and the additive fluid in the drill string and the return fluid in an annulus in the wellbore; and wherein the drill string further comprises a first axially extending flow channel having the base fluid and a second axially extending flow channel having the additive fluid.

10. The method of claim 9, further comprising operating the master controller to:

determine a measured pressure gradient based on measurements received from the plurality of valve subs; and compare the measured pressure gradient to a model pressure gradient stored by the master controller, wherein the master controller is operable to actuate each of the plurality of valve subs to dispense additive fluid and modify the density of the return fluid to maintain a desired fluid pressure gradient in the wellbore.

11. The method of claim 9, wherein the first axially extending flow channel exits the drill string at a drill bit and the second flow channel is nested in the first flow channel, the method further comprising:

controllably discharging a portion of additive fluid from inside the second flow channel to the annulus via the plurality of valve subs at a plurality of locations uphole from the drill bit to modify the equivalent circulating density of the return fluid, wherein each of the plurality of valve subs comprises a base fluid flow channel operatively coupled to the first flow channel of the drill string, and an additive fluid flow channel operatively coupled to the second flow channel of the drill string.

12. The method of claim 9, wherein each of the plurality of valve subs is coupled to a common communications channel.

13. The method of claim 9, wherein each valve sub is operable to broadcast the operation actions taken by such valve sub on the communications channel.

14. The method of claim 9, wherein each valve sub is operable to receive a broadcast communication from another valve sub, such broadcast communication including a record of the actions taken by such other valve sub.

15. The method of claim 9, wherein a setting for each of the plurality of valve subs is selected based on a model stored at the master controller.

16. The method of claim 9, wherein a first valve sub of the plurality of valve subs is operable to receive a communication of an equivalent circulating density from a second valve sub, and wherein the first valve sub is operable to determine the average equivalent circulating density of the wellbore between the first valve sub and the second valve sub based on the received equivalent circulating density and a local equivalent circulating density measurement determined by such first valve sub.

17. A drilling system comprising:

a drill string positioned within a wellbore to form an annulus between the drill string and the wall of the wellbore, the drill string comprising a drill pipe section having a plurality of valve subs spaced at intervals along the drill pipe section, wherein the plurality of valve subs are in hydraulic communication with a base fluid and an additive fluid in the drill string and a return fluid in an annulus in the wellbore, wherein the drill string further comprises a first axially extending flow channel having the base fluid and a second axially extending flow channel having the additive fluid, wherein a first valve sub of the plurality of valve subs comprises a master controller having a processor and a memory, and wherein the master controller is operatively coupled with the first valve sub and each of the other valve subs to electronically actuate at least one of a first and a second valve of at least one of the first valve sub and the plurality of valve subs to selectively discharge, at least a portion of, the base fluid and the additive fluid from inside the drill pipe section into the annulus to change at least one parameter of interest of the return fluid.

18. The system of claim 17, wherein the master controller is positioned within the first valve sub and is operable to determine a measured pressure gradient based on measurements received from the plurality of valve subs, and to compare the measured pressure gradient to a model pressure gradient stored by the master controller, and wherein the master controller is operable to actuate each of the plurality of valve subs to dispense additive fluid and modify the density of the return fluid to maintain a desired fluid pressure gradient in the wellbore.

19. The system of claim 17, wherein the first axially extending flow channel exits the drill string at a drill bit and the second flow channel is nested in the first flow channel, wherein the plurality of valve subs controllably discharge a portion of additive fluid from inside the second flow channel to the annulus at a plurality of locations uphole from the drill bit to modify the equivalent circulating density of the return fluid, and wherein each of the plurality of valve subs comprises a base fluid flow channel operatively coupled to the first flow channel of the drill string, and an additive fluid flow channel operatively coupled to the second flow channel of the drill string.

20. The system of claim 17, wherein a setting for each of the plurality of valve subs is selected based on a model stored at the master controller.

* * * * *